US009173804B2

(12) United States Patent
Ishikawa et al.

(10) Patent No.: US 9,173,804 B2
(45) Date of Patent: Nov. 3, 2015

(54) LOWER-LEG MASSAGE DEVICE

(75) Inventors: Tetsuya Ishikawa, Higashi-Osaka (JP); Shigeki Noda, Higashi-Osaka (JP); Shinsaku Shimizu, Higashi-Osaka (JP)

(73) Assignee: DAITO ELECTRIC MACHINE INDUSTRY COMPANY LIMITED, Higashi-Osaka-Shi, Osaka ( * ) Notice: Subject to any disclaimer, the term of this patent is extended or adjusted under 35 U.S.C. 154(b) by 663 days.

(21) Appl. No.: 13/255,773

(22) PCT Filed: Aug. 23, 2010

(86) PCT No.: PCT/JP2010/064199

§ 371 (c)(1),
(2), (4) Date: Sep. 9, 2011

(87) PCT Pub. No.: WO2011/058801

PCT Pub. Date: May 19, 2011

(65) Prior Publication Data

US 2012/0095376 A1 Apr. 19, 2012

(30) Foreign Application Priority Data

Nov. 16, 2009 (JP) ..... 2009-260936
Jun. 15, 2010 (JP) ..... 2010-136042

(51) Int. Cl.
*A61H 15/00* (2006.01)

(52) U.S. Cl.
CPC .... *A61H 15/0078* (2013.01); *A61H 2015/0014* (2013.01); *A61H 2201/1669* (2013.01); *A61H 2201/1676* (2013.01); *A61H 2205/106* (2013.01); *A61H 2205/12* (2013.01)

(58) Field of Classification Search
CPC ..... A61H 7/00; A61H 7/002; A61H 7/004; A61H 7/007; A61H 15/00; A61H 15/0078; A61H 2205/12; A61H 2205/106; A61H 2201/1676; A61H 2201/1669
USPC ..... 601/27–35, 84, 90, 93, 97, 101, 104, 601/133
See application file for complete search history.

(56) References Cited

U.S. PATENT DOCUMENTS 6,599,261 B1 * 7/2003 Chen ..... 601/115
6,629,940 B2 10/2003 Shimizu
6,969,361 B2 * 11/2005 Hsieh ..... 601/127
7,147,611 B2 * 12/2006 Kassel et al. ..... 601/90

(Continued)

FOREIGN PATENT DOCUMENTS

CN 1988871 A 6/2007
JP 59-40020 Y2 11/1984

(Continued)

*Primary Examiner* — Justine Yu
*Assistant Examiner* — Timothy Stanis
(74) *Attorney, Agent, or Firm* — Birch, Stewart, Kolasch & Birch, LLP

(57) ABSTRACT

There is provided a massage device capable of producing innovative and comfortable massage effect by massaging a target body part over a wide area in its lengthwise direction with substantially rectilinear motion of a pressure-applying point. The massage device 1 comprises a pair of treatment members 23, 24 arranged face-to-face with each other at a spacing large enough for insertion of part of human body; a holding mechanism 162 for holding and pressing the body part in sandwich style by moving at least one of the paired treatment members or both of them 23, 24 in the direction of width of the body part set in place between the paired treatment members; and a moving mechanism 26 for moving the treatment member 23, 24 in the direction of length of the body part while maintaining the holding condition of the treatment member 23, 24 effected by the holding mechanism 162.

16 Claims, 18 Drawing Sheets

(56) References Cited

U.S. PATENT DOCUMENTS

| | | | | |
|---|---|---|---|---|
| 2004/0186399 | A1* | 9/2004 | Tseng | 601/112 |
| 2005/0137502 | A1* | 6/2005 | Harashima et al. | 601/84 |
| 2006/0069332 | A1* | 3/2006 | Huang | 601/90 |
| 2006/0142676 | A1 | 6/2006 | Fujii et al. | |
| 2008/0103420 | A1* | 5/2008 | Ishiguro et al. | 601/90 |
| 2010/0137758 | A1* | 6/2010 | Nagamitsu et al. | 601/97 |

FOREIGN PATENT DOCUMENTS

| | | | | |
|---|---|---|---|---|
| JP | 8-89540 | A | | 4/1996 |
| JP | 11-267164 | A | | 10/1999 |
| JP | 11-347082 | A | | 12/1999 |
| JP | 2001-112833 | A | | 4/2001 |
| JP | 2001-286520 | A | | 10/2001 |
| JP | 2002-143249 | A | | 5/2002 |
| JP | 2004-89282 | A | | 3/2004 |
| JP | 2004-202207 | A | | 7/2004 |
| JP | 2006-296567 | A | | 11/2006 |
| JP | 2008237295 | A | | 10/2008 |
| JP | 2009050583 | A | * | 3/2009 |

* cited by examiner

LOWER-LEG MASSAGE DEVICE

TECHNICAL FIELD

The present invention relates to a massage device.

BACKGROUND ART

As one of conventional massage devices capable of massaging lower legs (between below-knee and ankle regions, in particular) of a user, there is known a massage device implemented in a footrest of a chair-type massage apparatus (Patent Literature 1, for example). This massage device has a pair of right-hand and left-hand treatment recesses, and an air bag is disposed on each of the opposite spaced inwardly-directed side surfaces, as well as on both sides of the intermediate wall, of the paired recesses. The air bags are each inflated and deflated by an air supply-exhaust unit, thereby massaging the lower legs put in their respective treatment recesses at the same time.

In general, an air bag is so inflated that its dimension increases to a maximum at the midportion, and decreases gradually with approach toward each end. Therefore, a sufficiently high pressing force is exerted only in a narrow range of the lower leg in its lengthwise direction. With this in view, there is proposed a massage device equipped with a plurality of air bags juxtaposed in a direction longitudinally of each treatment recess, for massaging lower legs over a wide area in the lengthwise direction by supplying air to and exhausting air from the air bags concurrently or sequentially (Patent Literature 2, for example).

By way of contrast, there is proposed a massage device that employs, instead of an air bag, a mechanism for moving opposite wall portions constituting a treatment recess close to and away from lower legs (Patent Literature 3, for example).

PRIOR ART REFERENCE

Patent Literature

Patent Literature 1: Japanese Examined Patent Publication JP-B2 3012780

Patent Literature 2: Japanese Unexamined Patent Publication JP-A 11-347082 (1999)

Patent Literature 3: Japanese Examined Patent Publication JP-B2 3339849

SUMMARY OF THE INVENTION

Problems to be Solved by the Invention

The conventional massage device, be it the airbag system disclosed in Patent Literatures 1 and 2 or the mechanical system disclosed in Patent Literature 3, is designed simply to give a massage to a body part put in the treatment recess by means of a pair of opposed treatment members. After all, such a massage device merely repeats a cycle of pressure application only to fixed points on the body part and release of the applied pressure, and inconveniently a resultant massage action is somewhat monotonous and lacks in a wide variety of movements.

Furthermore, a main purpose of a massage produced by the repetition of a cycle of pressure application to fixed points and release of the pressure is to impart pulsatory impulses to blood circulation, the flow of lymph, or nervous systems, in other words, to focus on waiting for spontaneous recovery from fatigue and revitalization of user's body. That is, the conventional massage device does not give the impression of being capable of improving the flow of blood and lymph in a practical and direct manner.

The present invention has been devised in view of the circumstances as mentioned supra, and accordingly its object is to provide a novel massage device capable of providing innovative and comfortable massage effect by massaging a target body part over a wide area in its lengthwise direction with a rectilinear motion of a pressure-applying point, as well as showing promise for practical and direct improvement of the flow of blood and lymph.

Means for Solving the Problems

In order to accomplish the above object, the following means is adopted for the implementation of the present invention.

That is, a massage device pursuant to the present invention comprises: a pair of treatment members arranged face-to-face with each other at a spacing large enough for insertion of part of human body; a holding mechanism for holding and pressing the body part in sandwich style by moving at least one of the paired treatment members or both of them in the direction of width of the body part set in place between the paired treatment members; and a moving mechanism for moving the treatment member in the direction of length of the body part while maintaining the holding condition of the treatment member effected by the holding mechanism.

By employing the structure as described above capable of allowing the treatment member to move in the lengthwise direction of the body part while being pressed against the body part, a finger-pressure massage can be performed continuously on the body part over a wide area in the lengthwise direction. This makes it possible to provide innovative and comfortable massage effect, as well as to show promise for practical and direct improvement of the flow of blood and lymph.

As used herein, the term "holding mechanism" is construed as encompassing a mechanism for bringing only one of the treatment members into a pressing condition.

It is advisable that the holding mechanism is provided with an advance-retraction driving section for driving the paired treatment members to advance to a hold-down (sandwich) position as well as to retract to a hold-off (release) position. When in the sandwich position, the paired treatment members are close to each other for holding and pressing the body part in sandwich style. When in the release position, the paired treatment members are spaced fully apart.

It is preferable that one end or the other end of the range of movement of the treatment member effected by the moving mechanism corresponds to the release position taken by the paired treatment members.

It is preferable that the treatment member is fist-shaped.

It is also preferable that between the paired treatment members is disposed a pressing member for pressing a different area of the body part than the area to be pressed by the treatment members. It is advisable that the moving mechanism is designed to move the pressing member along the lengthwise direction of the body part in synchronization with the movement of the paired treatment members.

The massage device of the present invention may be implemented by way of a lower-leg massage device designed so that, given the body part as "a calf" which is part of a lower leg lying in a knee to ankle range, the holding mechanism operates the paired treatment members in a manner to hold the calf in sandwich style while applying pressure to the right and left sides thereof.

The massage device of the present invention may be implemented by way of a lower-leg massage device designed so that, given the body part as "a calf" which is part of a lower leg lying in a knee to ankle range, the holding mechanism operates the paired treatment members in a manner to hold the calf in sandwich style while applying pressure to an obliquely outward part of the front side of the calf in a transverse direction and the back side of the calf.

The massage device of the present invention may be implemented by way of a lower-leg massage device designed so that, given the body part as "a foot" which is part of a lower leg lying below ankle, the holding mechanism operates the paired treatment members in a manner to hold the foot in sandwich style while applying pressure to the right and left sides thereof.

The massage device of the present invention may be implemented by way of an arm massage device designed so that, given the body part as "an arm", the holding mechanism operates the paired treatment members in a manner to hold the arm in sandwich style while applying pressure to the right and left sides thereof.

It is advisable to provide a pair of treatment recesses, of which each is formed of a region between the paired treatment members. In this case, the paired treatment recesses are arranged side by side, with their lengthwise directions pointing in the same direction.

Advantageous Effect of the Invention

According to the massage device of the present invention, a finger-pressure massage can be performed on a certain body part over a wide area in its lengthwise direction. This makes it possible to provide innovative and comfortable massage effect, as well as to show promise for practical and direct improvement of the flow of blood and lymph.

MODES FOR CARRYING OUT THE INVENTION

Hereinafter, embodiments of the present invention will be described with reference to the drawings.

First Embodiment

FIGS. 1 to 13 show a massage device in accordance with a first embodiment of the present invention.

By way of the first embodiment, there is shown a massage device 1 intended for the right and left lower legs of a user, which is designed to perform a sandwich-style massage and a massage, like a finger-pressure massage, produced by a rectilinear force on each of a calf L and a foot F constituting the lower leg at the same time.

It is noted that, in the present description, the term "calf L" refers to part of the lower leg of a human in a range from below the knee to above the ankle, and the term "foot F" refers to part of the lower leg in a range downwardly from the ankle. Moreover, in FIGS. 1 and 2, the direction indicated by an arrow X is defined as a front-rear direction, the direction indicated by an arrow Y is defined as a right-left, or transverse direction (widthwise direction), and the direction indicated by an arrow Z is defined as a top-bottom, or longitudinal direction.

Figure 2:
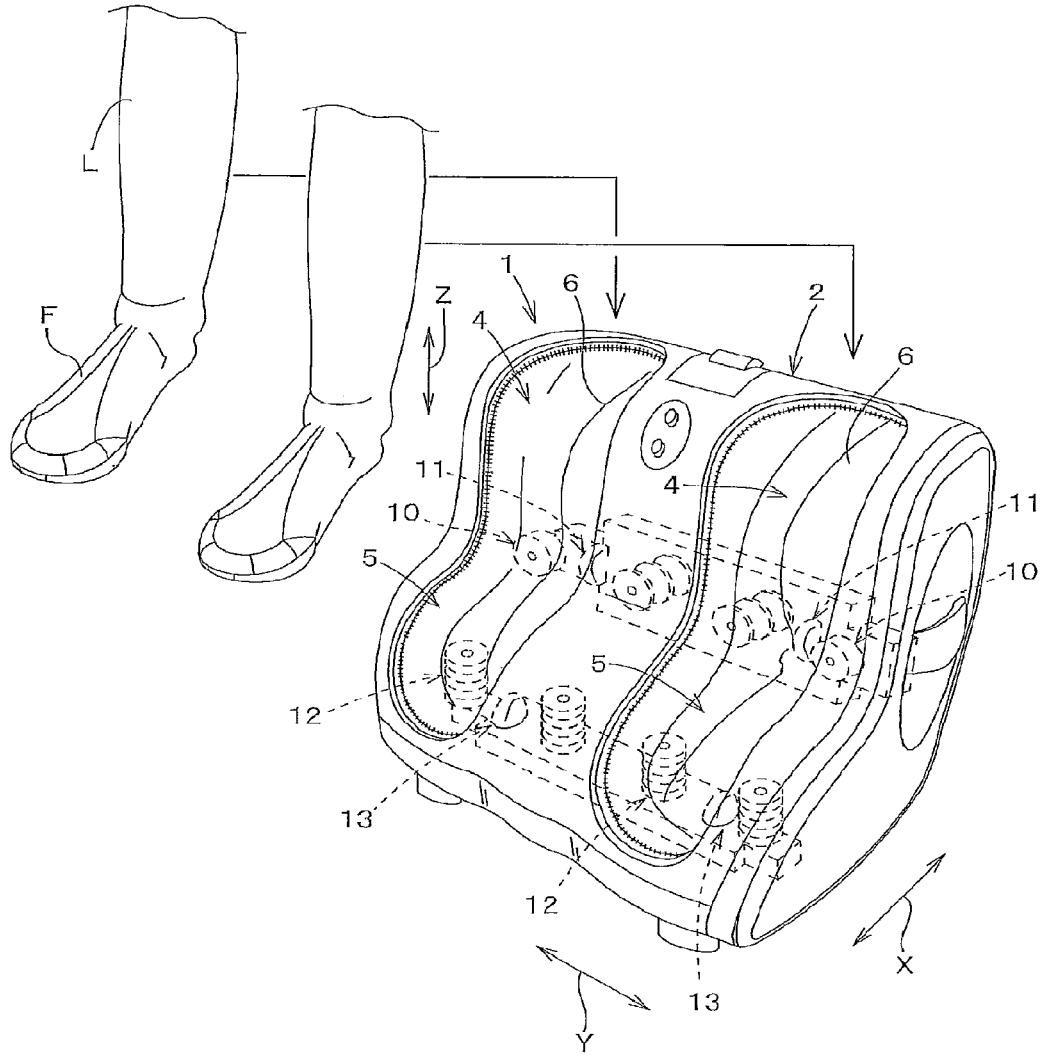
FIG. 2 is a front perspective view showing the appearance of the massage device in accordance with the first embodiment of the present invention.

As shown in FIG. 2, the massage device 1 of the first embodiment is provided with a casing 2 which is of a transversely or longitudinally-elongated rectangular or square shape when viewed from in front, and is of a boot-like shape when viewed from a side.

The casing 2 has a pair of right-hand and left-hand first treatment recesses 4 that are spaced apart in the transverse direction, each of which is a recessed opening formed on substantially upper half of the front of the casing from below upward. The right and left calves L can be inserted into the right-hand and left-hand first treatment recesses 4, respectively.

Also, the casing 2 has a pair of right-hand and left-hand second treatment recesses 5 that are spaced apart in the transverse direction, each of which is a recessed opening formed on substantially lower half of the front of the casing from above downward. The right and left feet F can be inserted into the right-hand and left-hand second treatment recesses 5, respectively.

In the interest of concurrent insertion of the calf L and the foot F in the first treatment recess 4 and the second treatment recess 5, respectively, the right-hand first treatment recess 4 and the right-hand second treatment recess 5 are made continuous with each other, and so are the left-hand first treatment recess 4 and the left-hand second treatment recess 5.

Inside the first treatment recess 4, as well as the second treatment recess 5, there is disposed a lining 6 comprising a cushion material such as sponge or urethane and a cover member such as a highly extensible cloth or leather. It is desirable to impart adequate breathability to the lining 6. On an as needed basis, the lining 6 may be provided with a heating or cooling mechanism. Moreover, it is advisable that the cover member is made detachable by adopting attaching means such as a zip fastener or hook-and-loop fastener for easy replacement as required.

The right-hand and left-hand first treatment recesses 4 are each provided with a vertical side-pressing massage mechanism 10 for massaging the calf L at both sides and a vertical back-pressing massage mechanism 11 for massaging the calf L at the back (rear).

The right-hand and left-hand second treatment recesses 5 are each provided with a horizontal side-pressing massage mechanism 12 for massaging the foot F at both sides and a horizontal back-pressing massage mechanism 13 for massaging the foot F at the back (sole).

It is noted that, in the massage device 1 of the first embodiment, the casing 2 is made changeable in position between a stand-up position and a lying-down position (with its front side facing upward) to suit user's needs. That is, when sitting on a chair or the like, a user is able to use the device with the casing 2 set in the stand-up position. On the other hand, when lying on his/her back on a bed or the like, a user is able to use the device with the casing 2 set in the lying-down position or in a tilted state.

Thus, the terms "vertical" and "horizontal" in the designations of the vertical side-pressing massage mechanism 10 and the vertical back-pressing massage mechanism 11 of the first treatment recess 4, as well as the horizontal side-pressing massage mechanism 12 and the horizontal back-pressing massage mechanism 13 of the second treatment recess 5, are used merely for the sake of convenience in the description, and are not to be construed as limiting the conditions for use of the massage device 1.

As shown in FIG. 1 and FIGS. 3 to 5, a support frame 15 is attached to the casing 2 interiorly thereof. The support frame 15 is composed of a base frame portion 16 standing substantially horizontal at a lower-end position, and a back frame portion 17 extending substantially vertically in an upward direction from the rear end of the base frame portion 16. The base frame portion 16 and the back frame portion 17 are integral to form the monolithic support frame 15 in the shape of the letter L when viewed from a side.

In the support frame 15, the base frame portion 16 bears the horizontal side-pressing massage mechanism 12 and the horizontal back-pressing massage mechanism 13, whereas the back frame portion 17 bears the vertical side-pressing massage mechanism 10 and the vertical back-pressing massage mechanism 11.

Figure 4:
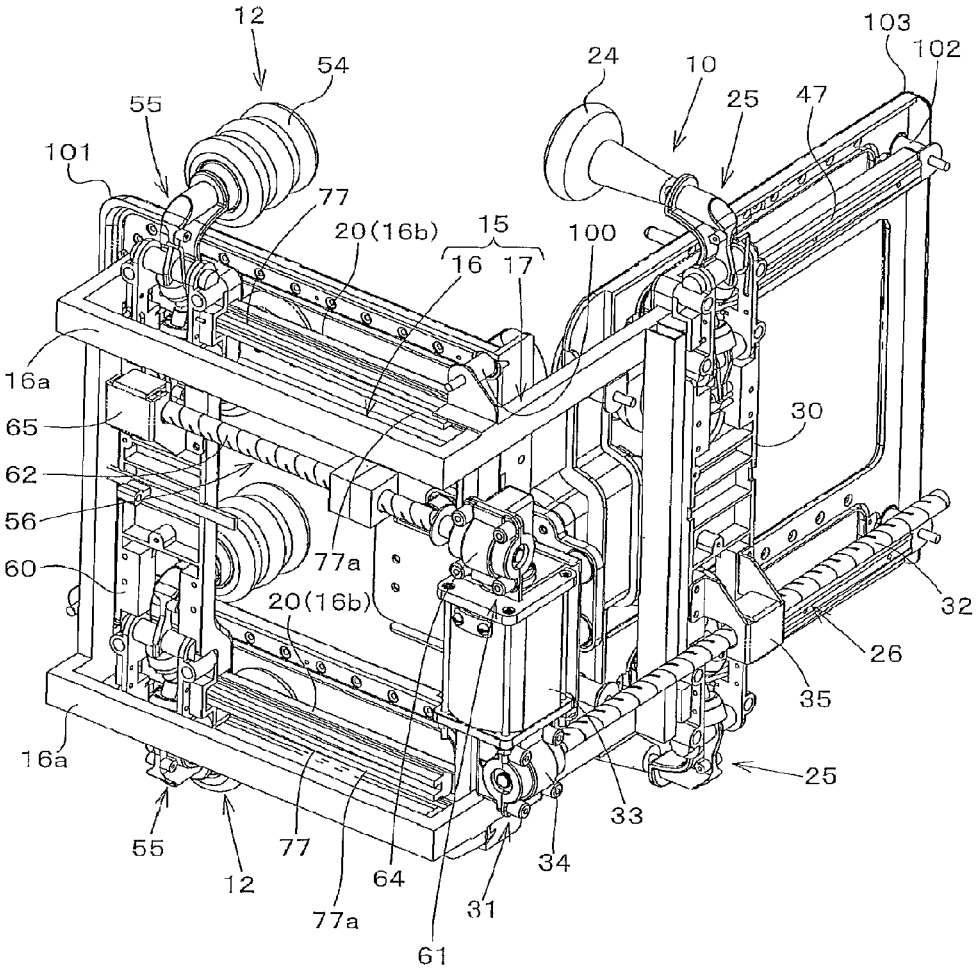
FIG. 4 is a bottom perspective view showing the internal structure of the massage device in accordance with the first embodiment of the present invention.

As shown in FIG. 4, the base frame portion 16 includes a pair of right-hand and left-hand leg bars 16*a* for floor mounting, and a pair of right-hand and left-hand horizontal bars 16*b* that are placed above the leg bars 16*a*, with their lengthwise directions aligned with the front-rear direction, so as to secure a space with respect to a floor. Each of the right-hand and left-hand horizontal bars 16*b* is uniform in sectional profile (thickness) throughout its length in the front-rear direction, and constitutes a horizontal rail 20 for moving the horizontal side-pressing massage mechanism 12 and the horizontal back-pressing massage mechanism 13 in the front-rear direction.

Figure 3:
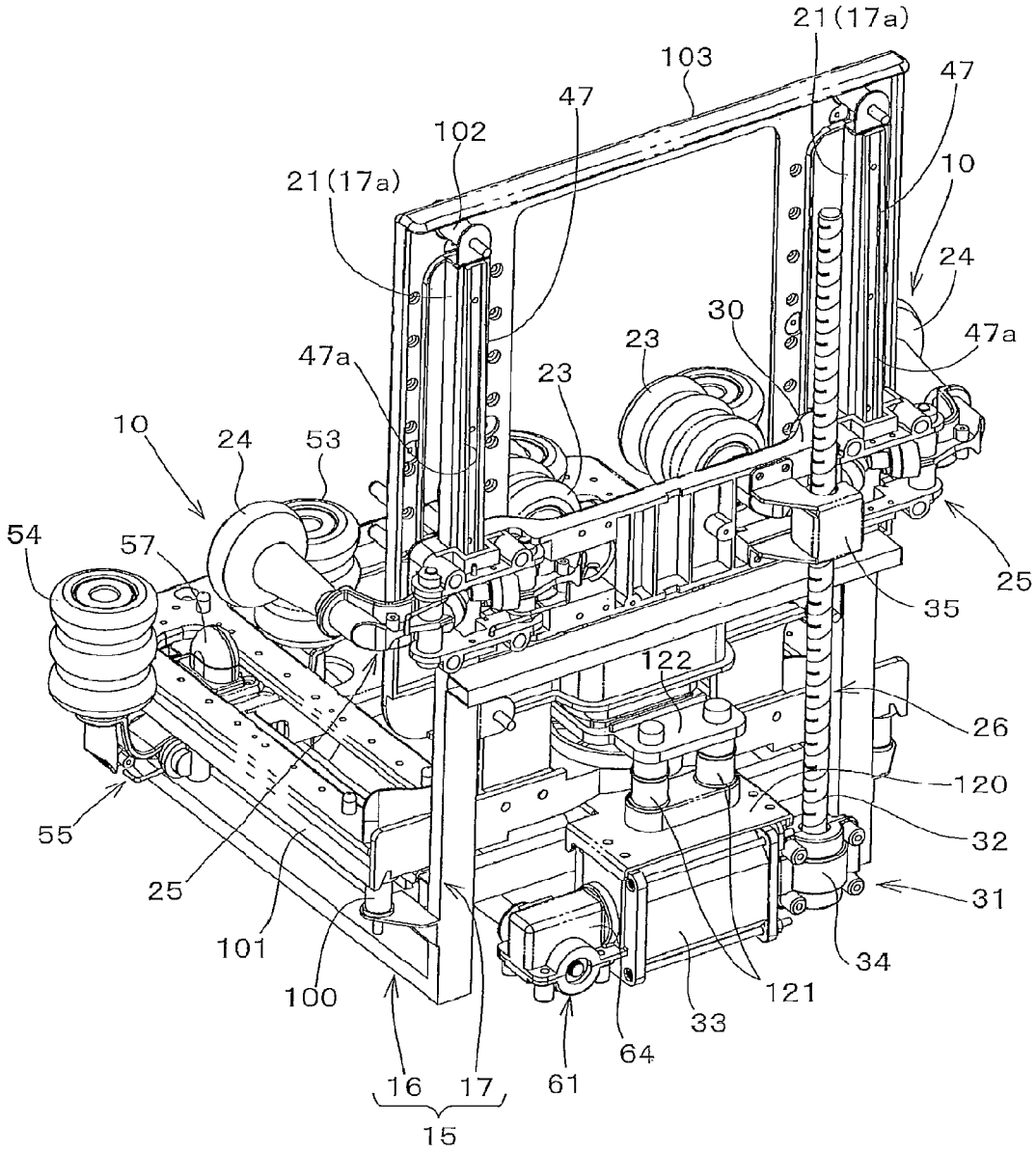
FIG. 3 is a back perspective view showing the internal structure of the massage device in accordance with the first embodiment of the present invention.

On the other hand, as shown in FIG. 3, the back frame portion 17 includes a pair of right-hand and left-hand vertical bars 17*a* that are placed with their lengthwise directions aligned with the longitudinal direction. Each of the right-hand and left-hand vertical bars 17*a* is uniform in sectional profile (thickness) throughout its length in the longitudinal direction, and constitutes a vertical rail 21 for moving the vertical side-pressing massage mechanism 10 and the vertical back-pressing massage mechanism 11 in the longitudinal direction.

To begin with, referring mainly to FIG. 3, the vertical side-pressing massage mechanism 10 and the vertical back-pressing massage mechanism 11 will be described.

The vertical side-pressing massage mechanism 10 comprises side-pressing treatment members 23 and 24 arranged side by side at a predetermined spacing (refer to FIG. 1), a holding mechanism 25 for operating the treatment members 23 and 24 in a manner to press the calf L, and a moving mechanism 26 for imparting up-and-down motion to the treatment members 23 and 24 and the holding mechanism 25.

The vertical back-pressing massage mechanism 11 comprises a pressing member 27 for pressing the back of the calf L set in place between the paired treatment members 23 and 24. Since the moving mechanism 26 is shareable between the vertical back-pressing massage mechanism 11 and the vertical side-pressing massage mechanism 10, it follows that the vertical back-pressing massage mechanism 11 is moved up and down concurrently with the vertical side-pressing massage mechanism 10.

In the moving mechanism 26 of the vertical side-pressing massage mechanism 10, a vertical movement slider 30 is retained for free up-and-down motion relative to the paired right-hand and left-hand vertical rails 21 of the back frame portion 17. The vertical movement slider 30 is driven to move up and down by a raising-lowering driving section 31. The vertical side-pressing massage mechanism 10 and the vertical back-pressing massage mechanism 11 are attached relatively to the vertical movement slider 30.

In the first embodiment, the raising-lowering driving section 31 is illustrated as having a feed screw shaft 32 placed with its lengthwise direction aligned with the longitudinal direction, a motor 33 operable in forward and reverse directions and a reduction gear portion 34 for rotatably driving the feed screw shaft 32, and a nut member 35 disposed on the vertical movement slider 30 for threadable engagement with the feed screw shaft 32 in impaled fashion. The motor 33 and the reduction gear portion 34 are fixed in the inside of the support frame 15 (in the vicinity of the intersection of the base frame portion 16 and the back frame portion 17).

Figure 1:
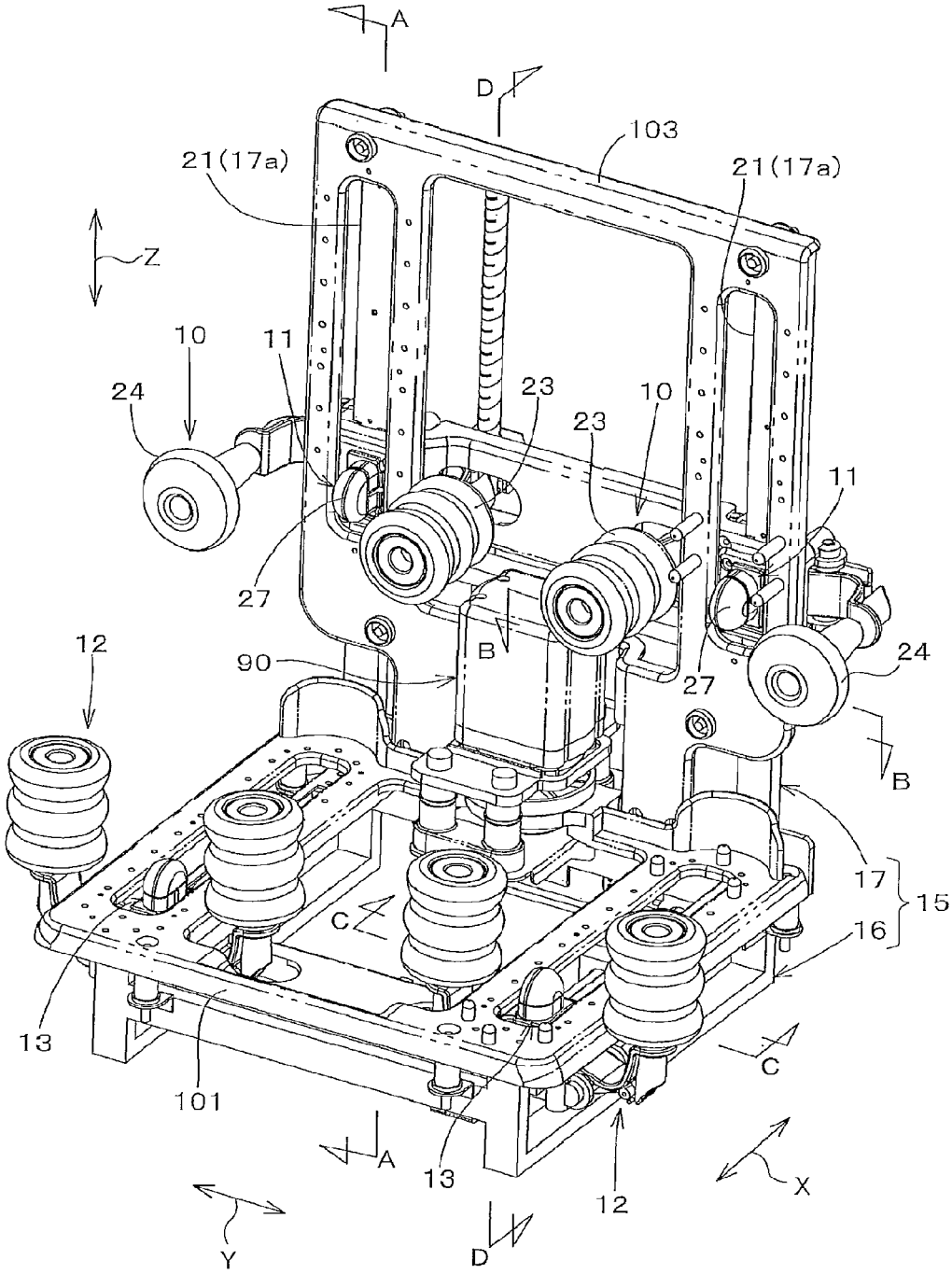
FIG. 1 is a front perspective view showing the internal structure of a massage device in accordance with a first embodiment of the present invention.

As shown in FIG. 1, the treatment members 23 and 24 of the vertical side-pressing massage mechanism 10 are arranged in a pair, and the pair is provided for each of the right and left lower legs of a user (user's body) on an individual basis, or a total of two pairs of the treatment members in all. That is, the treatment members 23 and 24 are arranged vis-à-vis in the transverse direction at a spacing large enough for easy insertion of one of the calves L. Thus, the treatment members 23 and 24 constitute a single treatment recess, namely the first treatment recess 4 (refer to FIG. 2).

Figure 6:
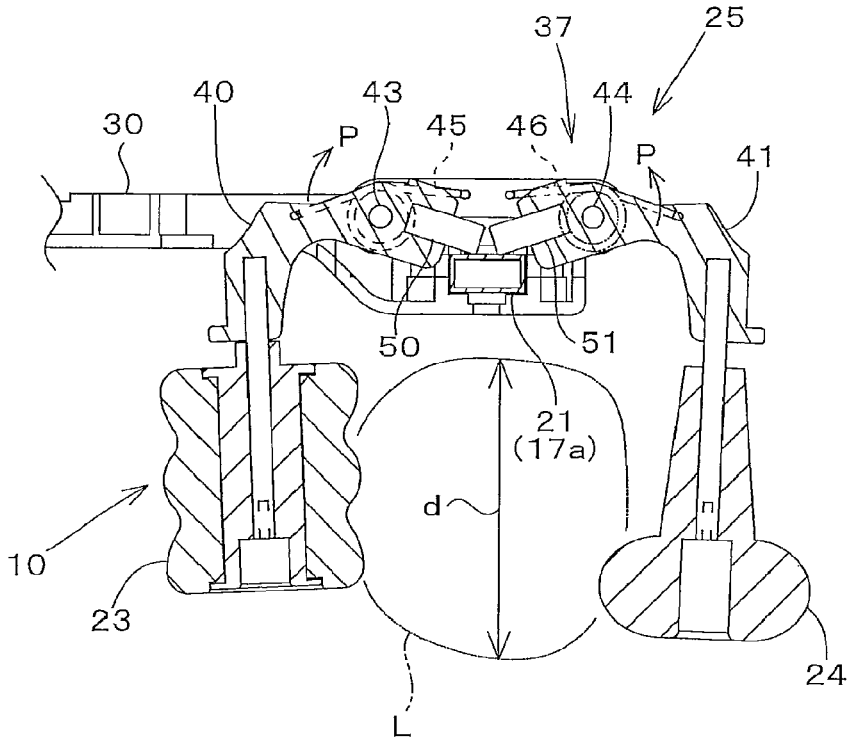
FIG. 6 is a sectional view taken along the line B-B of FIG. 1 (release position).

As shown in FIG. 6, the treatment member 23 disposed face-to-face with the inner side of the calf L has basically the form of a cylinder which extends with its axis pointing in the front-rear direction, has a length substantially equal to the lateral thickness d (the thickness in the front-rear direction) of the calf L, and is constricted at two locations on its outer peripheral surface in the lengthwise direction.

On the other hand, the treatment member 24 disposed face-to-face with the outer side of the calf L has the form of a disk with an axis pointing in the front-rear direction. The discotic treatment member 24 is made flat with respect to the front-rear direction so as to make contact with the calf L only in a range from the side surface near to the front surface (in a relatively narrow range). This makes it possible to increase the surface pressure on the calf L properly, and thereby produce a relatively strong stimulus as is desirable.

The treatment members 23 and 24 are each fist-sized as well as fist-shaped. As the material of construction of these members, an elastic material such as plastic and hard resin can be adopted for use.

Meanwhile, the holding mechanism 25 of the vertical side-pressing massage mechanism 10 operates, when the calf L is set in place between the treatment members 23 and 24, the treatment members 23 and 24 in a manner to press both sides of the calf L in the transverse direction.

Figure 7:
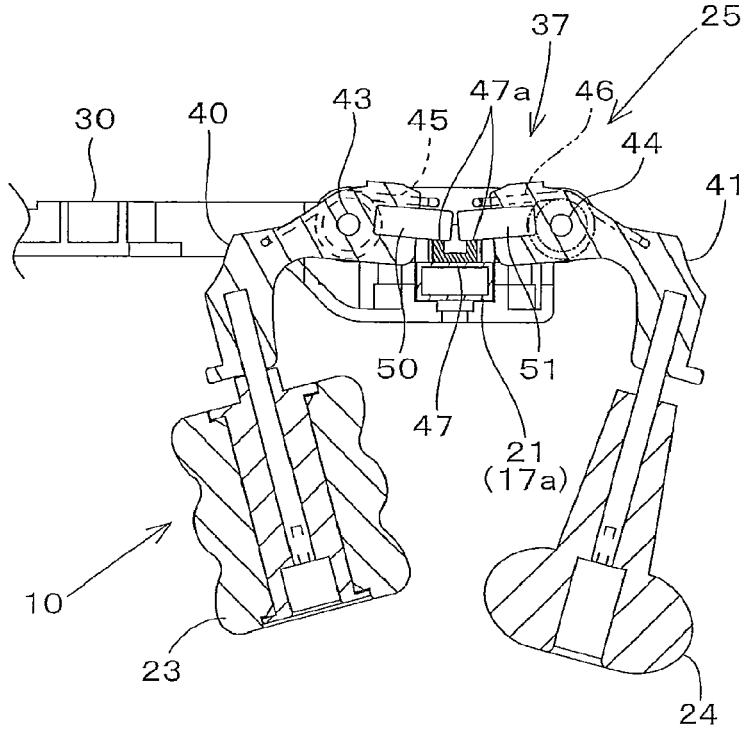
FIG. 7 is a sectional view taken along the line B-B of FIG. 1 (sandwich position).

In the first embodiment, the holding mechanism 25 is provided with an advance-retraction driving section 37 for allowing the treatment members 23 and 24 to move advanceably and retractably between a hold-off (release) position (as shown in FIG. 6) and a hold-down (sandwich) position (as shown in FIG. 7) (to move closer to and away from each other) individually and positively.

When in the release position, the treatment members 23 and 24 stay out of the way of insertion and extraction of the calf L in the region between them.

As shown in FIGS. 6 and 7, the advance-retraction driving section 37 comprises: support arms 40 and 41 for supporting the treatment members 23 and 24; rocking shafts 43 and 44 for pivotally supporting the support arms 40 and 41 for free horizontal rocking motion relative to the vertical movement slider 30; release actuators 45 and 46 for actuating the support arms 40 and 41 so that the treatment members 23 and 24 can be moved away from each other (so as to open up the space between them); and a cam rail 47 for imparting camming action to the base end of the support arm 40, 41 (the cam rail 47 is not depicted in FIG. 6).

The support arms 40 and 41 are shaped like the letter L when viewed from a top, and have their base ends extended toward each other at least in a region between the rocking shafts 43 and 44. The opposed base ends are formed with follower pins 50 and 51, respectively, that can be brought into contact with the rear surface of the cam rail 47. The bend (angle) of the letter L defining the shape of the support arm 40, 41 is so determined that, when the treatment members 23 and 24 assume a pressing position, the follower pins 50 and 51 are so arranged as to extend toward each other in a substantially linear fashion.

Specifically, the release actuators 45 and 46 are each constructed of a legged coiled spring whose legs protrude radially outwardly, and are installed so as to surround the rocking shafts 43 and 44, respectively. The coiled spring has its one leg engaged with the support arm 40, 41, and has the other leg engaged with the vertical movement slider 30. Therefore, the treatment members 23 and 24 are subjected to a springy force tending to move them away from each other (move them in the opening-up direction) as indicated by arrows P in FIG. 6.

As shown in FIG. 3, the cam rail 47 is secured to the back side of the vertical bar 17*a* (constituting the vertical rail 21), with its lengthwise direction aligned with the longitudinal direction, relative to the back frame portion 17 of the support frame 15. The rear surface of the cam rail 47 is made as a cam face 47*a* (with which the follower pin 50, 51 of the support arm 40, 41 makes sliding contact).

Figure 5:
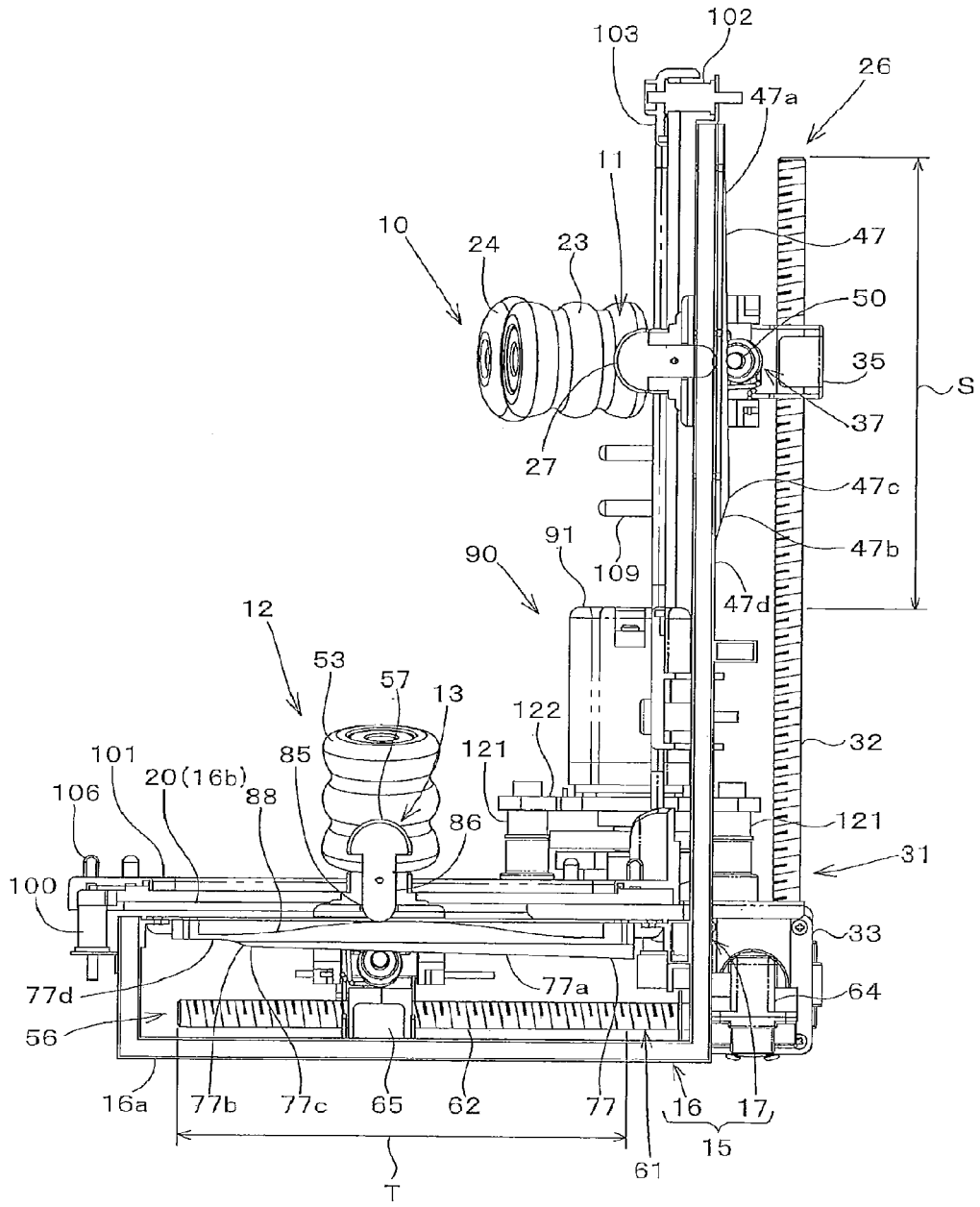
FIG. 5 is a sectional view taken along the line A-A of FIG. 1.

Moreover, as shown in FIG. 5, the cam rail 47 is so shaped that its rail thickness (the length from the vertical bar 17*a* to the rearward end) becomes smaller gradually from the bottom to the top, or becomes larger gradually from the top to the bottom. That is, the cam face 47*a* is inclined with respect to the direction of length of the vertical bar 17*a*. Moreover, the length of the cam rail 47 is so determined that its lower end falls short of the lower limit of an operating range S within which the vertical movement slider 30 moves up and down along the back frame portion 17. The cam rail 47 has formed at its lower end a ramp guide face 47*b* inclined in an opposite direction relative to the cam face 47*a*.

It can thus be said that the cam rail 47 is an inclined cam in the form of an angle, and its vertex 47*c* defining the point of connection between the cam face 47*a* and the ramp guide face 47*b* corresponds to the thick of the cam rail (a part most distant from the rear surface of the vertical bar 17*a*). Moreover, a location below the lower end of the cam rail 47, viz., a part departing from the cam rail 47 (where the rear surface of the vertical bar 17*a* faces rearward in an exposed state) is, when taken to represent the cam rail 47, a zero-thickness area constituting a camming-free region 47*d*.

According to the configuration of the cam rail 47 thus far described, as the vertical movement slider 30 is moved up and down along the vertical rail 21 (the vertical bar 17*a*), so the support arms 40 and 41 are moved up and down. At this time, the strength of rearward force exerted on the follower pin 50, 51 of the support arm 40, 41 varies in conformity with the configuration of the cam face 47*a* of the cam rail 47. Since the support arms 40 and 41 are actuated by the release actuators 45 and 46 to urge the treatment members 23 and 24 in the direction away from each other (to open up the space between them), it follows that the urging action helps keep the follower pin 50, 51 in contact with the cam face 47*a* of the cam rail 47.

More specifically, when the treatment member 23, 24 is situated at the side of the lowermost part of the vertical rail 21, then the follower pin 50, 51 of the support arm 40, 41 lies in the camming-free region 47*d*, wherefore the treatment members 23 and 24 are spaced fully apart in the release position. In this state, the calf L can be put in and out of the region between the treatment members 23 and 24 with ease.

After that, the treatment member 23, 24 is moved upward along the vertical rail 21 and, upon reaching a position corresponding to substantially the midportion of the calf L in the longitudinal direction, then the follower pin 50, 51 comes to the vertex 47*c*. At this time, the treatment members 23 and 24 are closest to each other in the sandwich position. Further, when the treatment member 23, 24 is situated at the side of the upper part of the vertical rail 21, then the follower pin 50, 51 of the support arm 40, 41 lies at the cam face 47*a*. At this time, the treatment members 23 and 24 are close to each other in the sandwich position.

In this way, in response to the up-and-down movement of the vertical movement slider 30, the advance-retraction driving section 37 imparts advancing and retracting motion to the treatment members 23 and 24 for the movement between the release position and the sandwich position. Hence, the holding mechanism 25 having the advance-retraction driving section 37 is capable of allowing the treatment members 23 and 24 to keep on pressing the calf L set in place between them.

Next, the vertical back-pressing massage mechanism 11 mounted in the massage device 1 will be described.

As shown in FIGS. 1 and 5, the vertical back-pressing massage mechanism 11 comprises the pressing member 27.

As shown in FIG. 5, the pressing member 27 is fixedly disposed so as to protrude forward from the vertical movement slider 30 of the moving mechanism 26. The pressing member 27 has basically the form of a disk having a transversely pointing axis, the lateral profile of which is of a semicircular shape defined by the disk with its rear-half part removed.

The pressing member 27 is made flat with respect to the transverse direction so as to make contact with the calf L set in place between the treatment members 23 and 24 only at the midportion of the back side (in a relatively narrow range). This makes it possible to increase the surface pressure on the calf L properly, and thereby produce a relatively strong stimulus as is desirable.

Since the pressing member 27 is moved up and down concurrently with the treatment members 23 and 24 of the vertical side-pressing massage mechanism 10, it follows that the calf L is massaged effectively at three areas, namely the right side, the left side, and the back side.

Next, referring to FIGS. 1, 3, and 4, the horizontal side-pressing massage mechanism 12 and the horizontal back-pressing massage mechanism 13 mounted in the massage device 1 will be described.

It is noted that the horizontal side-pressing massage mechanism 12 and the horizontal back-pressing massage mechanism 13 have basically the same workings as those of the vertical side-pressing massage mechanism 10 and the vertical back-pressing massage mechanism 11 described hereinabove, and it can thus be said that the former 12 and 13 are substantially equal to the horizontal arrangement of the latter 10 and 11.

As shown in FIG. 1, the horizontal side-pressing massage mechanism 12 comprises side-pressing treatment members 53 and 54 arranged side by side at a predetermined spacing, a holding mechanism 55 for operating the treatment members 53 and 54 in a manner to press the foot F, and a moving mechanism 56 for imparting back-and-forth motion to the treatment members 53 and 54 and the holding mechanism 55.

The horizontal back-pressing massage mechanism 13 comprises a pressing member 57 for pressing the sole of the foot F set in place between the paired treatment members 53 and 54. The horizontal back-pressing massage mechanism 13 is moved back and forth concurrently with the horizontal side-pressing massage mechanism 12.

In the moving mechanism 56, a horizontal movement slider 60 is retained for free back-and-forth motion relative to the paired right-hand and left-hand horizontal rails 20 (horizontal bars 16*b*) of the base frame portion 16. The horizontal movement slider 60 is driven to move back and forth by an advance-retraction driving section 61. The horizontal side-pressing massage mechanism 12 and the horizontal back-pressing massage mechanism 13 are attached relatively to the horizontal movement slider 60.

The advance-retraction driving section 61 for driving the horizontal movement slider 60 comprises a feed screw shaft 62 placed with its lengthwise direction aligned with the front-rear direction, a motor 33 operable in forward and reverse directions and a reduction gear portion 64 for rotatably driving the feed screw shaft 62, and a nut member 65 attached to the horizontal movement slider 60 for threadable engagement with the feed screw shaft 62 in impaled fashion. The motor 33 is shareable between the advance-retraction driving section 61 and the raising-lowering driving section 31 of the vertical side-pressing massage mechanism 10. That is, the motor 33 is a double-shaft motor, one of the driving shafts of which is coupled to the reduction gear portion 34 of the raising-lowering driving section 31, and the other is coupled to the reduction gear portion 64 of the advance-retraction driving section 61.

As shown in FIG. 1, the treatment members 53 and 54 of the horizontal side-pressing massage mechanism 12 are arranged in a pair, and the pair is provided for each of the right and left lower legs of a user (user's body) on an individual basis, or a total of two pairs of the treatment members in all. That is, the treatment members 53 and 54 are arranged vis-à-vis in the transverse direction at a spacing large enough for easy insertion of one of the feet F. Thus, the treatment members 53 and 54 constitute a single treatment recess, namely the second treatment recess 5 (refer to FIG. 2).

Figure 8:
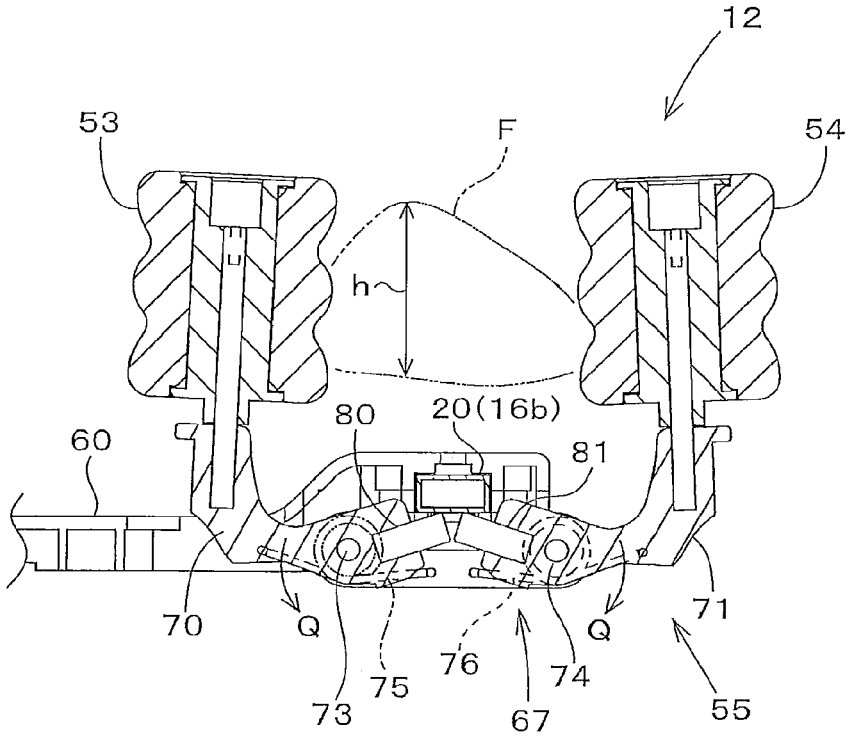
FIG. 8 is a sectional view taken along the line C-C of FIG. 1 (release position).

As shown in FIG. 8, each of the treatment member 53 disposed face-to-face with the inner side of the foot F and the treatment member 54 disposed face-to-face with the outer side of the foot F has basically the form of a cylinder with a longitudinally pointing axis that protrudes in a length somewhat greater than a height h of the foot F (the distance from a floor to the instep of the foot F) in the longitudinal direction, and is constricted at two locations on its outer peripheral surface in the lengthwise direction.

The treatment members 53 and 54 are each fist-sized as well as fist-shaped. As the material of construction of these members, an elastic material such as plastic and hard resin can be adopted for use.

Figure 9:
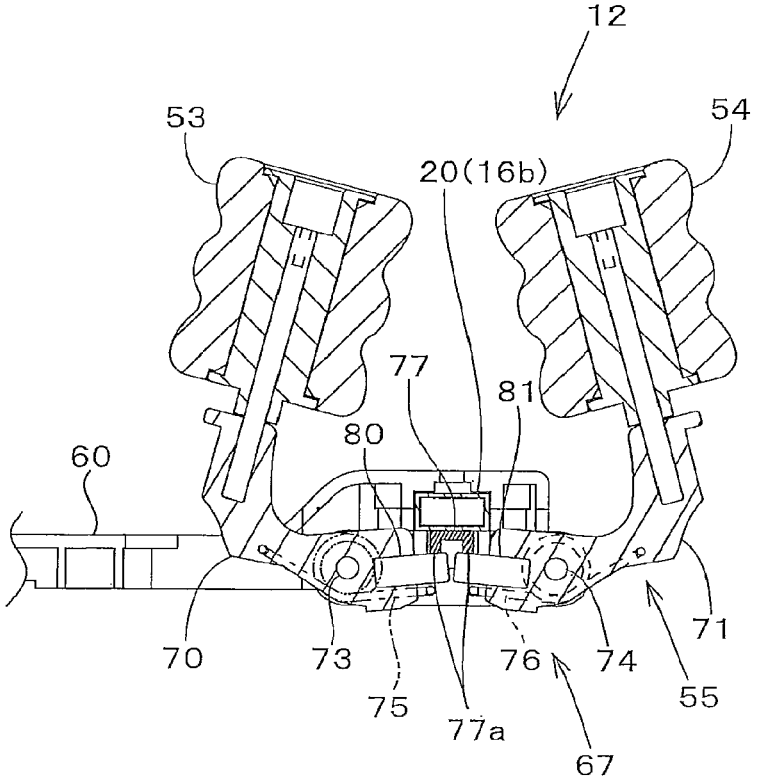
FIG. 9 is a sectional view taken along the line C-C of FIG. 1 (sandwich position).

The holding mechanism 55 operates, when the foot F is set in place between the treatment members 53 and 54, the treatment members 53 and 54 in a manner to press both sides of the foot F in the transverse direction. In the first embodiment, the holding mechanism 55 is provided with an advance-retraction driving section 67 for allowing the treatment members 53 and 54 to move advanceably and retractably between a hold-off (release) position (as shown in FIG. 8) and a hold-down (sandwich) position (as shown in FIG. 9). When in the release position, the paired treatment members 53 and 54 stay out of the way of insertion and extraction of the foot F in the region between them.

As shown in FIGS. 8 and 9, the advance-retraction driving section 67 comprises: support arms 70 and 71 for supporting the treatment members 53 and 54; rocking shafts 73 and 74 for pivotally supporting the support arms 70 and 71 for free vertical rocking motion relative to the horizontal movement slider 60; release actuators 75 and 76 for actuating the support arms 70 and 71 so that the treatment members 53 and 54 can be moved away from each other (so as to open up the space between them); and a cam rail 77 for imparting camming action to the base end of the support arm 70, 71 (the cam rail 77 is not depicted in FIG. 8).

The support arms 70 and 71 are shaped like the letter L when viewed from in front, and have their base ends extended toward each other at least in a region between the rocking shafts 73 and 74. The opposed base ends are formed with follower pins 80 and 81, respectively, that can be brought into contact with the lower surface of the cam rail 77. The bend (angle) of the letter L defining the shape of the support arm 70, 71 is so determined that, when the treatment members 53 and 54 assume a pressing position, the follower pins 80 and 81 are so arranged as to extend toward each other in a substantially linear fashion.

Specifically, the release actuators 75 and 76 are each constructed of a legged coiled spring whose legs protrude radially outwardly, and are installed so as to surround the rocking shafts 73 and 74, respectively. The coiled spring has its one leg engaged with the support arm 70, 71, and has the other leg engaged with the vertical movement slider 30. Therefore, the treatment members 53 and 54 are subjected to a springy force tending to move them away from each other (move them in the opening-up direction) as indicated by arrows Q in FIG. 8.

As shown in FIG. 4, the cam rail 77 is secured to the back side of the horizontal bar 16*b* (constituting the horizontal rail 20), with its lengthwise direction aligned with the front-rear direction, relative to the back frame portion 16 of the support frame 15. The rear surface of the cam rail 77 is made as a cam face 77*a* (with which the follower pin 80, 81 of the support arm 70, 71 makes sliding contact).

Moreover, as shown in FIG. 5, the cam rail 77 is so shaped that its rail thickness (the length from the horizontal bar 16*a* to the downward end) becomes smaller gradually from the rear to the fore, or becomes larger gradually from the fore to the rear. That is, the cam face 77*a* is inclined with respect to the direction of length of the horizontal bar 16*b*. Moreover, the length of the cam rail 77 is so determined that its forward end falls short of the fore limit of an operating range T within which the horizontal movement slider 60 moves back and forth along the base frame portion 16. The cam rail 77 has formed at its forward end a ramp guide face 77*b* which is inclined in the same direction as is the cam face 77*a* at a sharp angle.

It can thus be said that the cam rail 77 is an inclined cam in the form of an angle, and its vertex 77*c* defining the point of connection between the cam face 77*a* and the ramp guide face 77*b* corresponds to the thick of the cam rail (a part most distant from the lower surface of the horizontal bar 16*b*). Moreover, a location ahead of the forward end of the cam rail 77, viz., a part departing from the cam rail 77 (where the lower surface of the horizontal bar 16*b* faces downward in an exposed state) is, when taken to represent the cam rail 77, a zero-thickness area constituting a camming-free region 77*d*.

According to the configuration of the cam rail 77 thus far described, as the horizontal movement slider 60 is moved back and forth along the horizontal rail 20 (the horizontal bar 16*b*), so the support arms 70 and 71 are moved back and forth. At this time, the strength of downward force exerted on the follower pin 80, 81 of the support arm 70, 71 varies in conformity with the configuration of the cam face 77*a* of the cam rail 77. Since the support arms 70 and 71 are actuated by the release actuators 75 and 76 to urge the treatment members 53 and 54 in the direction away from each other (to open up the space between them), it follows that the urging action helps keep the follower pin 80, 81 in contact with the cam face 77*a* of the cam rail 77.

More specifically, when the treatment member 53, 54 is situated at the side of the forwardmost part of the horizontal rail 20, then the follower pin 80, 81 of the support arm 70, 71 lies in the caroming-free region 77*d*, wherefore the treatment members 53 and 54 are spaced fully apart in the release position. In this state, the foot F can be put in and out of the region between the treatment members 53 and 54 with ease.

After that, the treatment member 53, 54 is moved along the horizontal rail 20 and, upon reaching a position corresponding to substantially the midportion of the calf L in the longitudinal direction, the follower pin 80, 81 comes to the vertex 77*c* of the cam rail 77. At this time, the treatment members 23 and 24 are closest to each other in the sandwich position. Further, when the treatment member 23, 24 is situated at the side of the upper part of the vertical rail 21, then the follower pin 50, 51 lies at the cam face 47*a*. At this time, the treatment members 53 and 54 are close to each other in the sandwich position.

In this way, in response to the back-and-forth movement of the horizontal movement slider 60, the advance-retraction driving section 67 imparts advancing and retracting motion to the treatment members 53 and 54 for the movement between the release position and the sandwich position. Hence, the holding mechanism 55 having the advance-retraction driving section 67 is capable of allowing the treatment members 53 and 54 to keep on pressing the calf L set in place between them.

Next, the horizontal back-pressing massage mechanism 13 mounted in the massage device 1 will be described.

As shown in FIGS. 1 and 5, the horizontal back-pressing massage mechanism 13 comprises the pressing member 57.

The pressing member 57 is so disposed as to protrude upward from the horizontal movement slider 60 of the moving mechanism 56. The pressing member 57 has basically the form of a disk having a transversely pointing axis, the lateral profile of which is of a semicircular shape defined by the disk with its lower-half part removed.

That is, the pressing member 57 is made flat with respect to the transverse direction so as to make contact with the foot F set in place between the treatment members 53 and 54 only at the midportion of the back side (sole) (in a relatively narrow range). This makes it possible to increase the surface pressure on the foot F properly, and thereby produce a relatively strong stimulus as is desirable.

Since the pressing member 57 is moved back and forth concurrently with the treatment members 53 and 54 of the horizontal side-pressing massage mechanism 12, it follows that the foot F is massaged effectively at three areas, namely the right side, the left side, and the back side (sole).

As shown in FIG. 5, in the first embodiment, the pressing member 57 is retained for free up-and-down motion relative to the horizontal movement slider 60. Moreover, the horizontal movement slider 60 has formed in its pressing member 57-bearing area a hole 85 passing therethrough in the longitudinal direction, and the pressing member 57 is formed with a follower 86 projecting into the hole 85. The tip (lower end) of the follower 86 is curved in an arc.

Moreover, a cam face 88, which abuts against the follower 86 of the pressing member 57, is attached relatively to the cam rail 77 or the horizontal bar 16*b* retaining the cam rail 77. The cam face 88 is convexly curved so as to conform to an arcuate curve defining the arch of the foot F (sole) set in place between the treatment members 53 and 54.

Thus, in response to the back-and-forth movement of the horizontal movement slider 60, the follower 86 moves up and down gently along the convex curve defining the cam face 88 while making sliding contact with the cam face 88. As a matter of course, the up-and-down movement of the follower 86 means the up-and-down movement of the pressing member 57. The up-and-down movement of the pressing member 57 is effected under the condition where the pressing member 57 is pressed by the foot F. Therefore the pressing member 57 can be moved without fail with little wobble.

In this way, a force like a finger pressure can be exerted properly also on the arch of the foot (sole) by the pressing member 57, with the result that the finger-pressure force, as well as the massage effect, is uniform throughout the sole of the foot.

Meanwhile, the massage device 1 of the first embodiment is provided with a vibration mechanism 90 aimed at providing a massage with a high degree of effectiveness.

The vibration mechanism 90 is designed to impart vibration produced by a vibration-generating motor 91 to the calf L and the foot F of a user. Hereinafter, the vibration mechanism 90 will be described.

As shown in FIG. 1 and FIGS. 3 to 5, a horizontal vibration plate 101 is supported, via a plurality of (four, in the illustrated example) shock-absorbing legs 100, on the top of the base frame portion 16 of the support frame 15. The shock-absorbing leg 100 comprises, for example, an elastic sleeve made of rubber, resin, or the like, for the prevention of propagation of vibration occurring in the horizontal vibration plate 101 toward the base frame portion 16.

In addition, a vertical vibration plate 103 is supported, via a plurality of (four, in the illustrated example) shock-absorbing legs 102, on the front of the back frame portion 17 of the support frame 15. The shock-absorbing leg 102 comprises, for example, an elastic sleeve made of rubber, resin, or the like, for the prevention of propagation of vibration occurring in the vertical vibration plate 103 toward the back frame portion 17.

Figure 10:
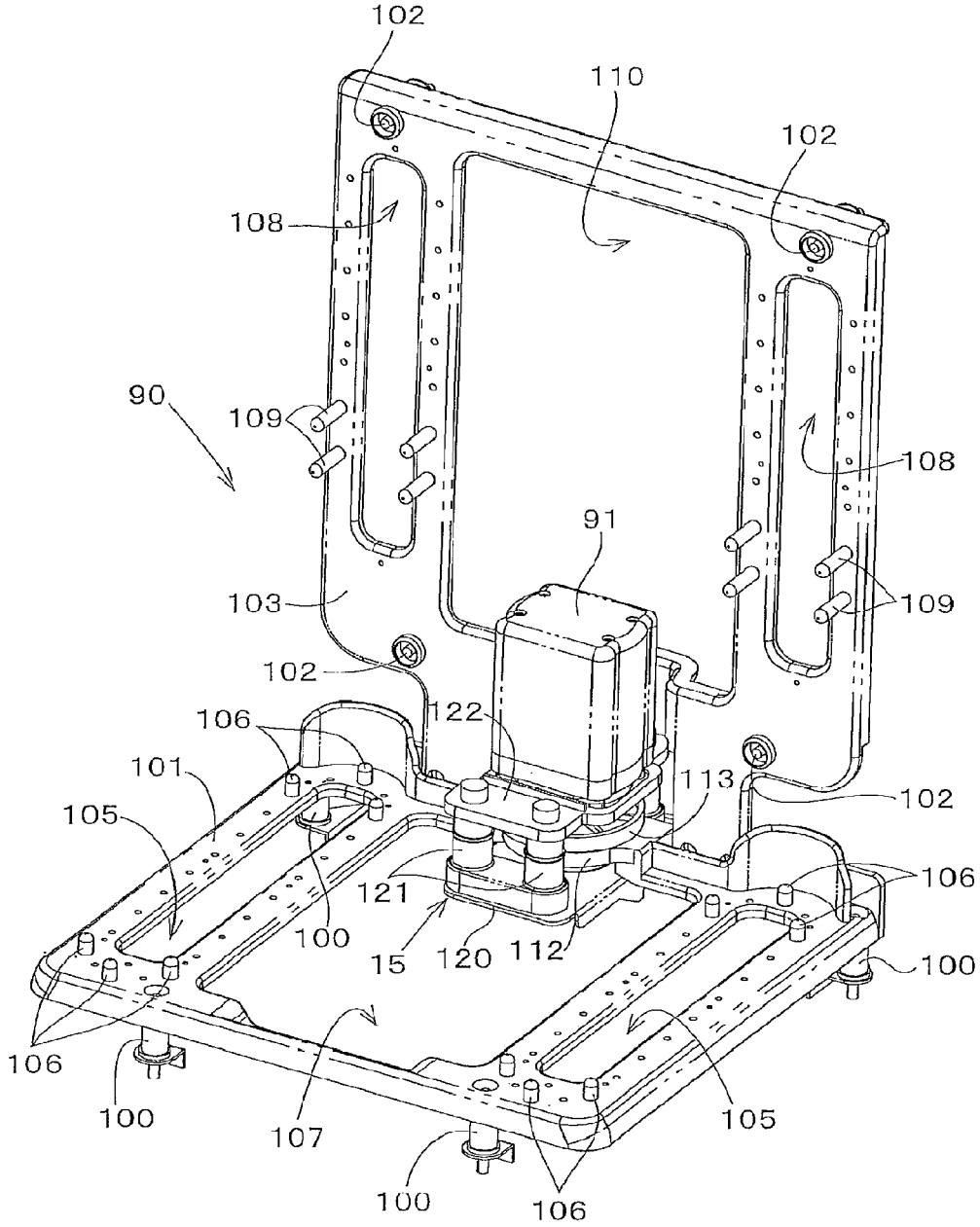
FIG. 10 is a perspective view showing a vibration mechanism extracted from the construction.

As shown in FIG. 10, the horizontal vibration plate 101 and the vertical vibration plate 103 are coupled to each other at their specific ends, namely the rear end of the horizontal vibration plate 101 and the lower end of the vertical vibration plate 103, so as to be integral to form a monolithic plate shaped like the letter L when viewed from a side.

The horizontal vibration plate 101 has a small opening 105 formed with its lengthwise direction aligned with the front-rear direction, for the sake of allowing the pressing member 57 of the horizontal back-pressing massage mechanism 13 to pass through the horizontal vibration plate 101 in the longitudinal direction, and avoiding interference (contact) with the pressing member 57 in a back-and-forth moving state. Moreover, upwardly-protruding finger-pressure projections 106 are arranged around the mouth of the small opening 105. The way of arrangement, the seated height, the material, and the number of the finger-pressure projection 106 may be determined selectively in accordance with the positions of pressure points on the sole.

In addition, the horizontal vibration plate 101 has a large opening 107 formed centrally of the plate surface thereof for the sake of allowing inwardly-located treatment members, namely the treatment member 53 of the right-hand horizontal side-pressing massage mechanism 12 and the treatment member 53 of the left-hand horizontal side-pressing massage mechanism 12, to pass through the horizontal vibration plate 101 in the longitudinal direction, and avoiding interference with the treatment member 53 in a back-and-forth moving state.

Likewise, the vertical vibration plate 103 has a small opening 108 formed with its lengthwise direction aligned with the front-rear direction, for the sake of allowing the pressing member 27 of the vertical back-pressing massage mechanism 11 to pass through the vertical vibration plate 103 in the front-rear direction, and avoiding interference with the pressing members 27 in a back-and-forth moving state. Moreover, forwardly-protruding finger-pressure projections 109 are arranged around the mouth of the small opening 108. The way of arrangement, the seated height, the material, and the number of the finger-pressure projection 109 can be determined selectively in accordance with the positions of pressure points on the back side of the calf L.

In addition, the vertical vibration plate 103 has a large opening 110 formed centrally of the plate surface thereof for the sake of allowing the inwardly-located treatment members, namely the treatment member 23 of the right-hand vertical side-pressing massage mechanism 10 and the treatment member 23 of the left-hand vertical side-pressing massage mechanism 10, to pass through the vertical vibration plate 103 in the front-rear direction, and avoiding interference with the treatment members 23 in an up-and-down moving state.

The horizontal vibration plate 101 has a vibration receiving pad 112 formed centrally of its rear end in the transverse direction so as to extend into the large opening 107. The vibration-generating motor 91 is retained in an inverted position (in a motor shaft-downward fashion) above the vibration receiving pad 112.

In the vibration-generating motor 91, a shaft bearing attachment such as a bearing is attached to the tip (lower end) of the motor shaft, so that the motor shaft can be rotatably retained on the vibration receiving pad 112 via the bearing. Also attached to the motor shaft of the vibration-generating motor 91 is an eccentric weight (flywheel) 113 situated in an midair position above the vibration receiving pad 112.

On the other hand, the support frame 15 is provided with a motor support 120 located in correspondence with the position of the vibration receiving pad 112 of the horizontal vibration plate 101. The motor support 120 is dimensioned to extend beyond the front and the rear of the vibration receiving pad 112. At each of the protruding forward and rear ends of the motor support 120 is disposed a pair of upwardly-extending right-hand and left-hand vibration-isolating legs 121 (a total of four vibration-isolating legs 121 in all). It is noted that, in the first embodiment, the motor support 120 serves also as a motor bracket for securing the motor 33 provided for the raising-lowering driving section 31 as well as the advance-retraction driving section 61 to the support frame 15 (refer to FIG. 3).

Moreover, a motor bracket 122 attached to the vibration-generating motor 91 is fixed to the upper-end parts of the vibration-isolating legs 121.

The vibration-isolating leg 121 comprises, for example, an elastic sleeve made of rubber, resin, or the like, for the prevention of propagation of vibration produced by the vibration-generating motor 91 toward the support frame 15.

Thus, when the eccentric weight 113 is rotated by the driving operation of the vibration-generating motor 91, then vibration is developed in the vibration-generating motor 91 in itself, and the vibration is transmitted, through the bearing attached to the motor shaft, to the vibration receiving pad 112 of the horizontal vibration plate 101. At this time, being formed integrally with each other, the horizontal vibration plate 101 and the vertical vibration plate 103 vibrate together. As a result, the vibration is transferred, through the finger-pressure projection 106 of the horizontal vibration plate 101, to the sole of the foot, and also transferred, through the finger-pressure projection 109 of the vertical vibration plate 103, to the back side of the calf F.

It is noted that the horizontal vibration plate 101 is coupled with the shock-absorbing leg 100, the vertical vibration plate 103 is coupled with the shock-absorbing leg 102, and the vibration-generating motor 91 is coupled with the vibration-isolating leg 121. This makes it possible to minimize the chances of transmission of the vibration to the support frame 15, and thereby prevent untoward noises and floor oscillation.

Now, a description will be given as to the operation of the massage device 1 of the first embodiment based on the conditions for use.

Figure 11:
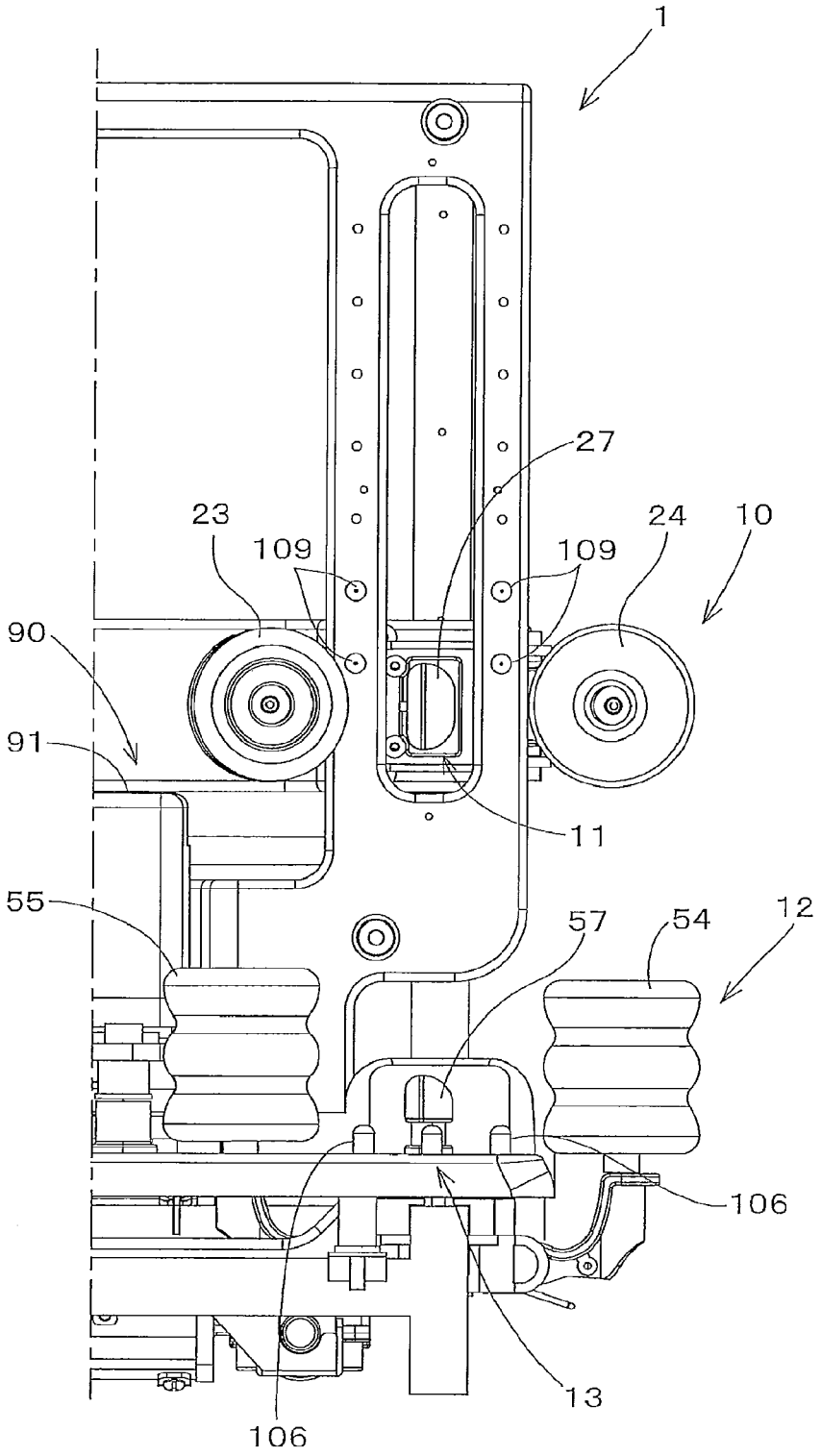
FIG. 11 is a view taken in the direction of the arrow along the line D-D of FIG. 1 (release position).

When the power switch or operation switch is in the OFF position, as shown in FIGS. 1 and 11, the massage device 1 stays with the treatment members 23 and 24 of the vertical side-pressing massage mechanism 10 kept at rest in their lowermost positions, and with the treatment members 53 and 54 of the horizontal side-pressing massage mechanism 12 kept at rest in their forwardmost positions.

The treatment members 23 and 24 remaining at rest in the lowermost positions are in a state of being spaced fully apart, and this state corresponds to the release position which is enabled by the holding mechanism 25 (the advance-retraction driving section 37) of the vertical side-pressing massage mechanism 10. Accordingly, in this state, the calf L can be put in and out of the region between the treatment members 23 and 24 with ease.

Moreover, the treatment members 53 and 54 remaining at rest in the forwardmost positions are in a state of being spaced fully apart, and this state corresponds to the release position which is enabled by the holding mechanism 55 (the advance-retraction driving section 67) of the horizontal side-pressing massage mechanism 12. Accordingly, in this state, the foot F can be put in and out of the region between the treatment members 53 and 54 with ease.

To begin with, a user inserts each of his/her right and left calves L in the region between the treatment members 23 and 24 (inside the first treatment recess 4), and also inserts each of his/her right and left feet F in the region between the treatment members 53 and 54 (inside the second treatment recess 5).

Under this condition, the power switch or operation switch is turned to the ON position, whereupon the motor 33 is set in motion. In the vertical side-pressing massage mechanism 10, the moving mechanism 26 starts to move the vertical movement slider 30 upward via the reduction gear portion 34 of the raising-lowering driving section 31. Moreover, in the horizontal side-pressing massage mechanism 12, the moving mechanism 56 starts to move the horizontal movement slider 60 backward via the reduction gear portion 64 of the advance-retraction driving section 61.

Figure 12:
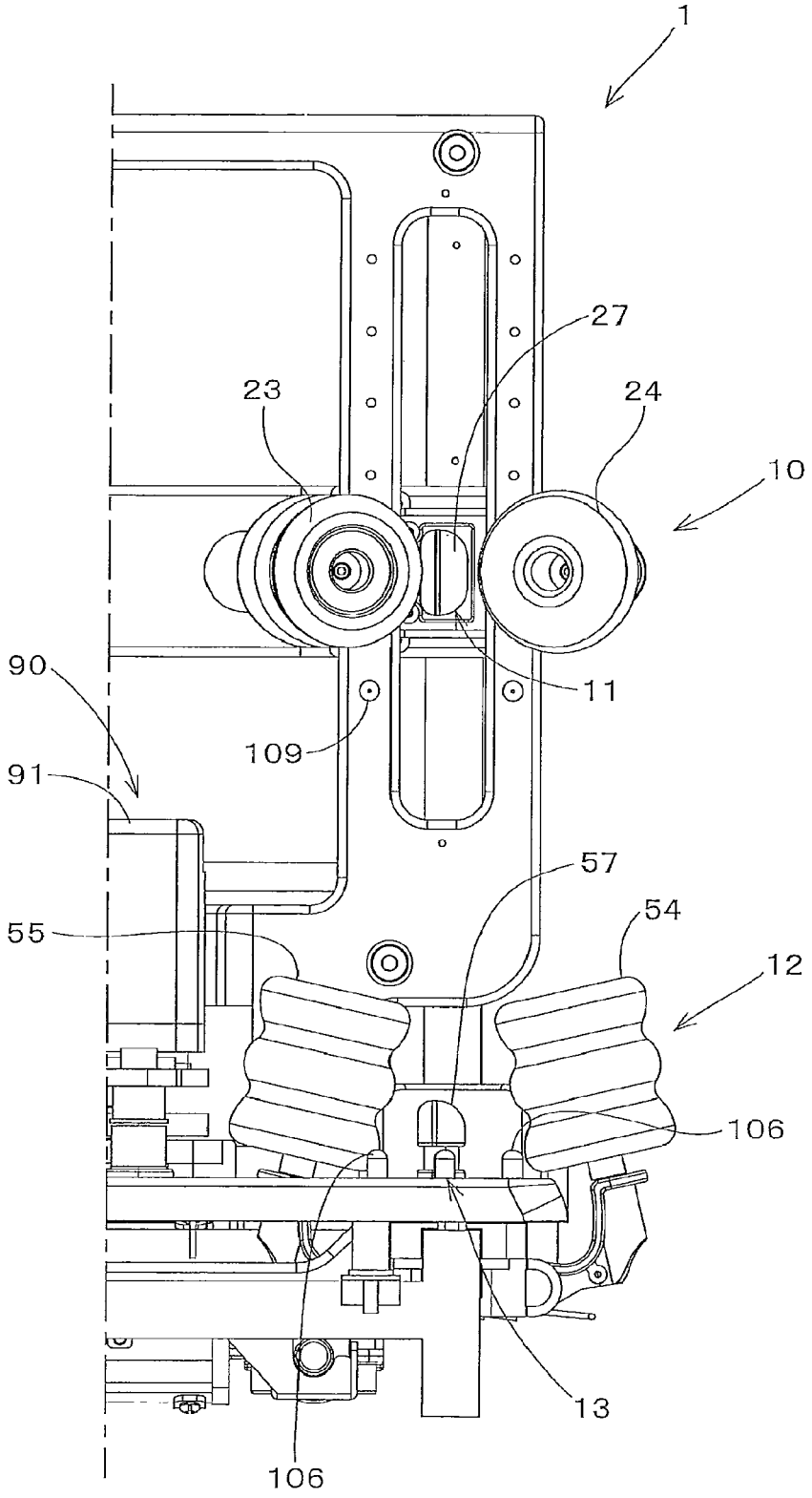
FIG. 12 is a view taken in the direction of the arrow along the line D-D of FIG. 1 (sandwich position).
Figure 13:
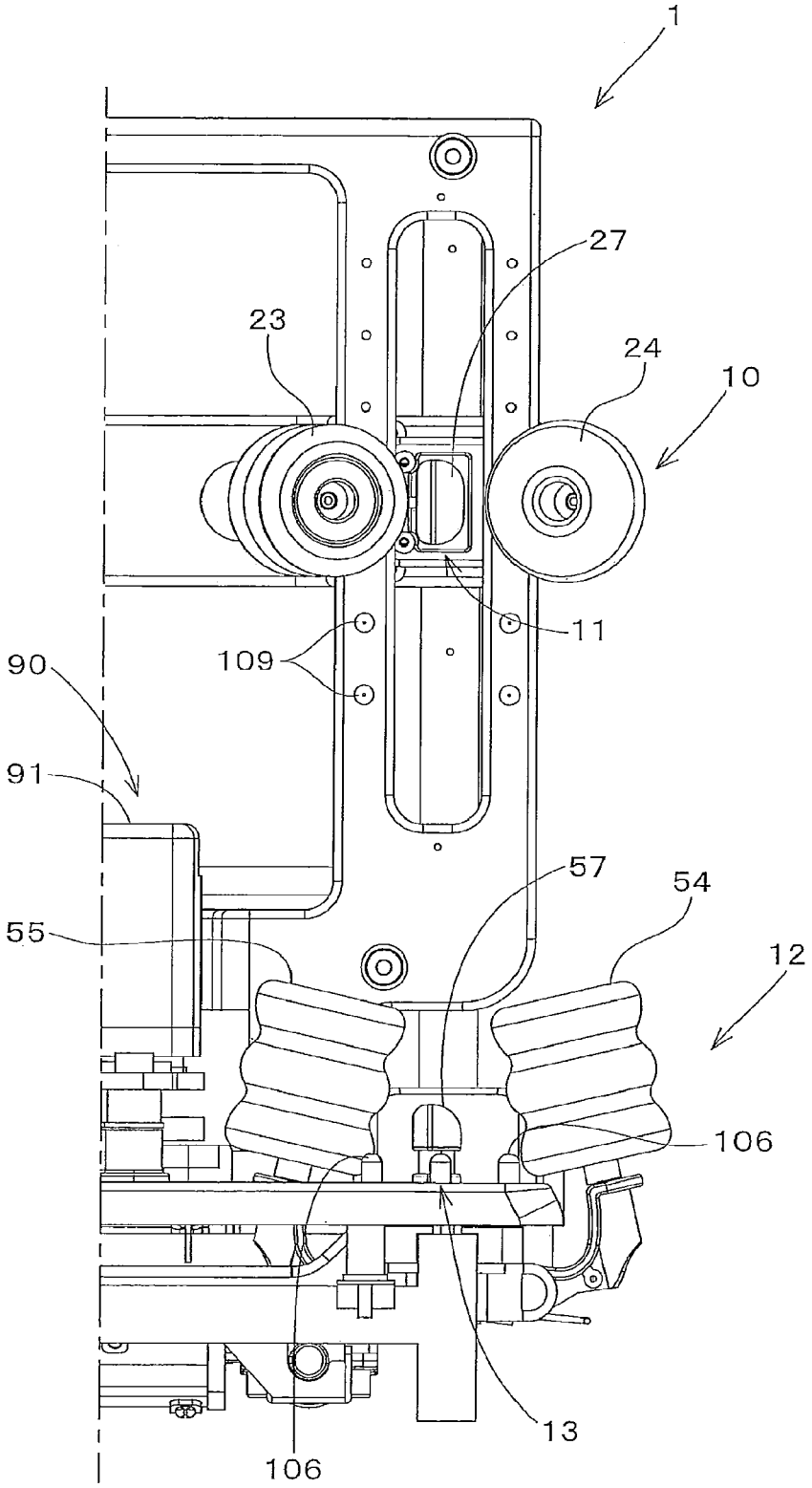
FIG. 13 is a view taken in the direction of the arrow along the line D-D of FIG. 1 (sandwich position).

In the vertical side-pressing massage mechanism 10, as the vertical movement slider 30 starts to move upward, the support arm 40, 41 (the follower pin 50, 51) is subjected to the caroming action of the cam rail 47, with the result that, as shown in FIG. 12, the treatment members 23 and 24 are firstly so moved that the distance between them decreases to a minimum. After that, as shown in FIG. 13, as the vertical movement slider 30 moves upward further and further, the treatment members 23 and 24 are so moved that the distance between them increases gradually.

Moreover, as the vertical movement slider 30 starts to move downward after reaching the upper limit of the operating range S, the treatment members 23 and 24 are contrariwise moved so that the distance between them decreases gradually. Such a movement of the treatment members 23 and 24 conforms to the shape of the calf L (adapted to variation in thickness of the calf). This makes it possible to perform a massage in a manner that a pressure-applying point is moved rectilinearly over a wide area of the calf F in its lengthwise direction.

A cycle of such an upward movement and downward movement of the vertical movement slider 30 is repeated at least one time, or several times as required. In the case of repeating the cycle over several times, it is advisable to adopt a system based on timer circuitry or counting circuitry, or a system based on manual switching operation.

At this time, in the vertical back-pressing massage mechanism 11, the pressing member 27 is in a state of pressing the back side of the calf L. That is, the calf L receives the finger-pressure force at three areas in total at one time.

On the other hand, in the horizontal side-pressing massage mechanism 12, as the horizontal movement slider 60 starts to move backward, the support arm 70, 71 (the follower pin 80, 81) is subjected to the camming action of the cam rail 77, with the result that, as shown in FIGS. 12 and 13, the treatment members 23 and 24 are so moved that the distance between them decreases gradually.

Moreover, as the horizontal movement slider 60 starts to move forward after reaching the rear limit of the operating range T, the treatment members 53 and 54 are contrariwise moved so that the distance between them increases gradually. Such a movement of the treatment members 53 and 54 conforms to the shape of the foot F (adapted to variation in width of the foot). This makes it possible to perform a massage in a manner that a pressure-applying point is moved rectilinearly over a wide area of the foot F in its lengthwise direction.

Similarly, a cycle of such a forward movement and backward movement of the horizontal movement slider 60 is repeated at least one time, or several times as required, in synchronization with the up-and-down movement of the vertical movement slider 30 described previously.

At this time, in the horizontal back-pressing massage mechanism 13, the pressing member 57 is in a state of pressing the sole. That is, the foot F receives the finger-pressure force at three areas in total at one time.

In addition to the functions of the treatment members 23 and 24, the pressing member 27, the treatment members 53 and 54, and the pressing member 57 to produce a finger-pressure massage, with the driving operation of the vibration mechanism 90, vibration can be applied to the calf L via the finger-pressure projection 106, as well as to the foot F via the finger-pressure projection 109. Accordingly, even more comfortable massage effect can be attained.

It will thus become possible to provide innovative and comfortable massage effect, as well as to show promise for practical and direct improvement of the flow of blood and lymph.

It is noted that the vibration mechanism 90 may be so designed that it can be activated and deactivated in a selective manner in accordance with the desire of a user. The vibration mechanism 90 may be designed to operate in synchronization with the vertical side-pressing massage mechanism 10 and the horizontal side-pressing massage mechanism 12 at all times, or may be designed to operate independently of each of the mechanisms.

Likewise, the vertical side-pressing massage mechanism 10 and the horizontal side-pressing massage mechanism 12 may be designed to operate in synchronization with each other at all times, or may be designed to operate independently of each other.

Second Embodiment

Figure 14:
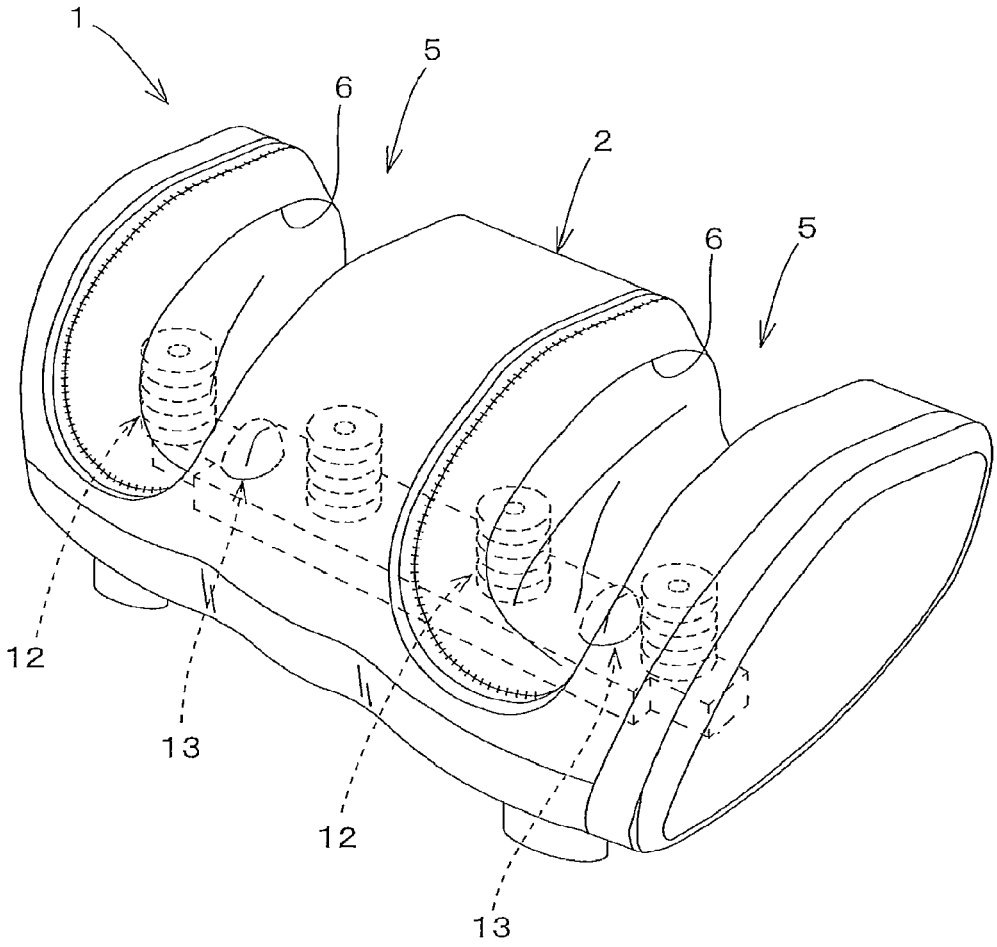
FIG. 14 is a perspective view showing the massage device in accordance with a second embodiment of the present invention.

FIG. 14 shows a massage device in accordance with a second embodiment of the present invention.

The massage device 1 of the second embodiment is tailored to a specific application such as a massage device for feet or a massage device for calves, and is therefore equipped only with the horizontal side-pressing massage mechanism 12 and the horizontal back-pressing massage mechanism 13 (the vertical side-pressing massage mechanism 10 and the vertical back-pressing massage mechanism 11 are not provided therein). This massage device is made very compact and adaptable to user needs, and thus come in very useful.

The second embodiment is otherwise similar to the first embodiment in structure, functioning effect, operating conditions, and so forth, and the detailed descriptions thereof will therefore be omitted. Moreover, the same reference symbols are utilized in designating constituent components corresponding with the first embodiment.

Third Embodiment

FIGS. 15 to 21 show a massage device in accordance with a third embodiment of the present invention.

The massage device 1 of the third embodiment has basically the same structure as that of the first embodiment (refer to FIGS. 1 to 13). That is, the massage device 1 is intended for the right and left lower legs of a user, and designed to perform a sandwich-style massage and a massage, like a finger-pressure massage, produced by a rectilinear motion on each of a calf L and a foot F constituting the lower leg at the same time.

As shown in FIGS. 15 to 18, just like the first embodiment, the massage device 1 of the third embodiment has a monolithic support frame 15 constructed in the shape of the letter L when viewed from a side.

Out of integral portions constituting the support frame 15, a base frame portion 16 is disposed at a lower-end position so as to stand substantially horizontal, whereas aback frame portion 17 is so disposed as to extend vertically in an upstanding position from the rear end of the base frame portion 16. The base frame portion 16 bears a horizontal massage mechanism 150 for massaging the foot F. The back frame portion 17 bears a vertical massage mechanism 151 for massaging the calf L.

Just like the first embodiment, the massage device 1 of the third embodiment is provided with a casing which is of a rectangular shape when viewed from in front, and is of a boot-like shape when viewed from a side. The casing has formed on its front surface a pair of right-hand and left-hand recesses for insertion of the right and left calves L and feet F. The graphical representation of the casing is omitted.

In the massage device 1 of the third embodiment, the horizontal massage mechanism 150 attached to the base frame portion 16 has platy treatment members 154 and 155 for performing a kneading massage on both sides of the foot F in the transverse direction. The horizontal massage mechanism 150 corresponds to the horizontal side-pressing massage mechanism 12 employed in the first embodiment.

Moreover, in the massage device 1 of the third embodiment, the vertical massage mechanism 151 attached to the back frame portion 17 has a front-pressing treatment member 160 and a back-pressing treatment member 161 for performing a finger-pressure massage on both sides of the calf L in the front-rear direction. The vertical massage mechanism 151 corresponds to the vertical side-pressing massage mechanism 10 and the vertical back-pressing massage mechanism 11 employed in the first embodiment.

Firstly, the vertical massage mechanism 151 will be described in detail.

The vertical massage mechanism 151 comprises: the front-pressing treatment member 160 for pressing an obliquely outward part of the front side of the calf L; the back-pressing treatment member 161 disposed face-to-face with the front-pressing treatment member 160, with the calf L lying between them, for supporting the calf L at its back side; a holding mechanism 162 for operating the front-pressing treatment member 160 and the back-pressing treatment member 161 in a manner to press the calf L; and a moving mechanism 26 for imparting up-and-down motion to the treatment members 160 and 161 and the holding mechanism 162.

The front-pressing treatment member 160 and the back-pressing treatment member 161 are arranged face-to-face with each other in the front-rear direction. This pair is disposed to the right and the left, respectively, of the device for the right lower leg and the left lower leg, respectively, of a user (user's body). As a matter of course, the holding mechanism 162 is provided for each of the pairs of the treatment members 160 and 161 on an individual basis.

In the moving mechanism 26, a rail retaining portion 163, which is disposed at each end of a vertical movement slider 30 in the transverse direction, is fitted for free up-and-down motion onto each of paired right-hand and left-hand vertical rails 21 attached to the back frame portion 17, and the vertical movement slider 30 is driven to move up and down by a raising-lowering driving section 31. In terms of the above structure, the moving mechanism is nearly identical to that of the first embodiment. As another point of similarity to the first embodiment, the treatment member 160, 161 and the holding mechanism 162 are disposed on both sides of the vertical movement slider 30 in the transverse direction.

As to the specific design of the raising-lowering driving section 31, it comprises a feed screw shaft 32 placed with its lengthwise direction aligned with the longitudinal direction, a motor 33 operable in forward and reverse directions and a reduction gear portion 34 coupled to the rear of the motor 33 for rotatably driving the feed screw shaft 32, and a nut member 35 attached to the vertical movement slider 30 for threadable engagement with the feed screw shaft 32 in impaled fashion. The motor 33 and the reduction gear portion 34 are fixed in the inside of the support frame 15 (fixed centrally of the upper part of the base frame portion 16 in the transverse direction).

Figure 19:
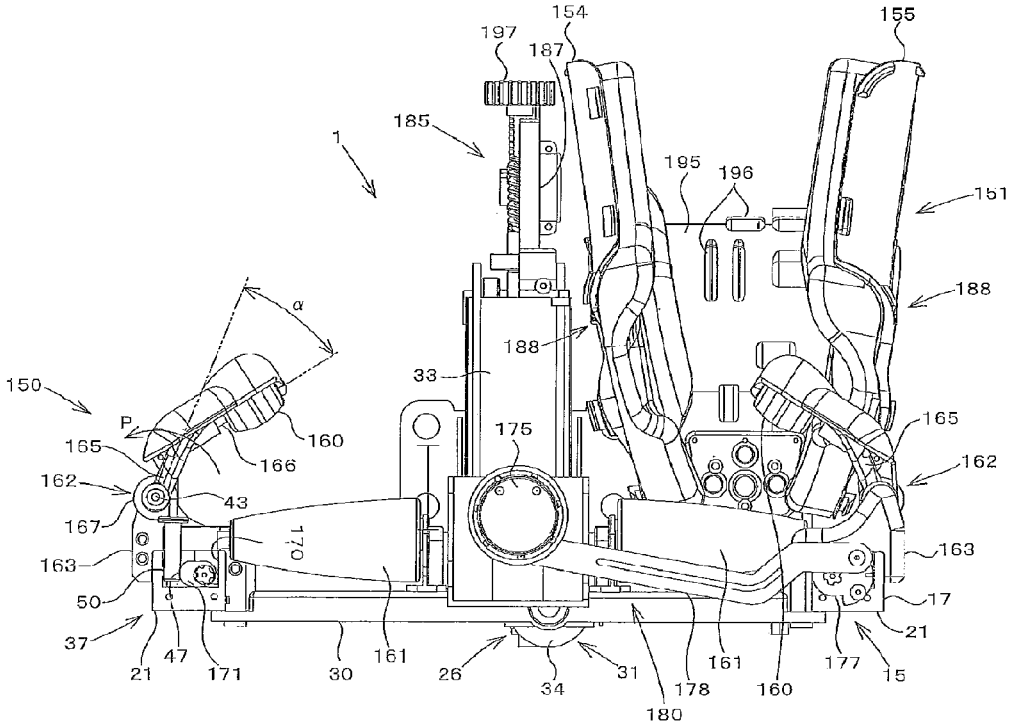
FIG. 19 is a sectional view, with parts omitted, taken along the line E-E of FIG. 16 (sandwich position, spaced interval: narrow).
Figure 20:
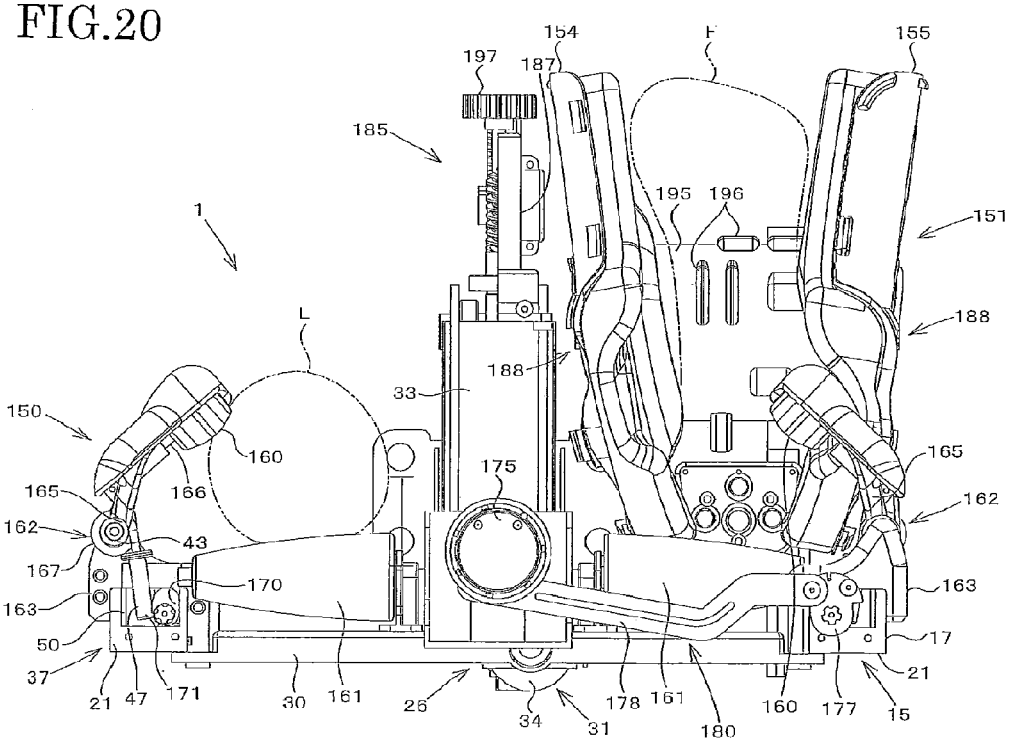
FIG. 20 is a sectional view, with parts omitted, taken along the line E-E of FIG. 16 (sandwich position, spaced interval: wide).
Figure 21:
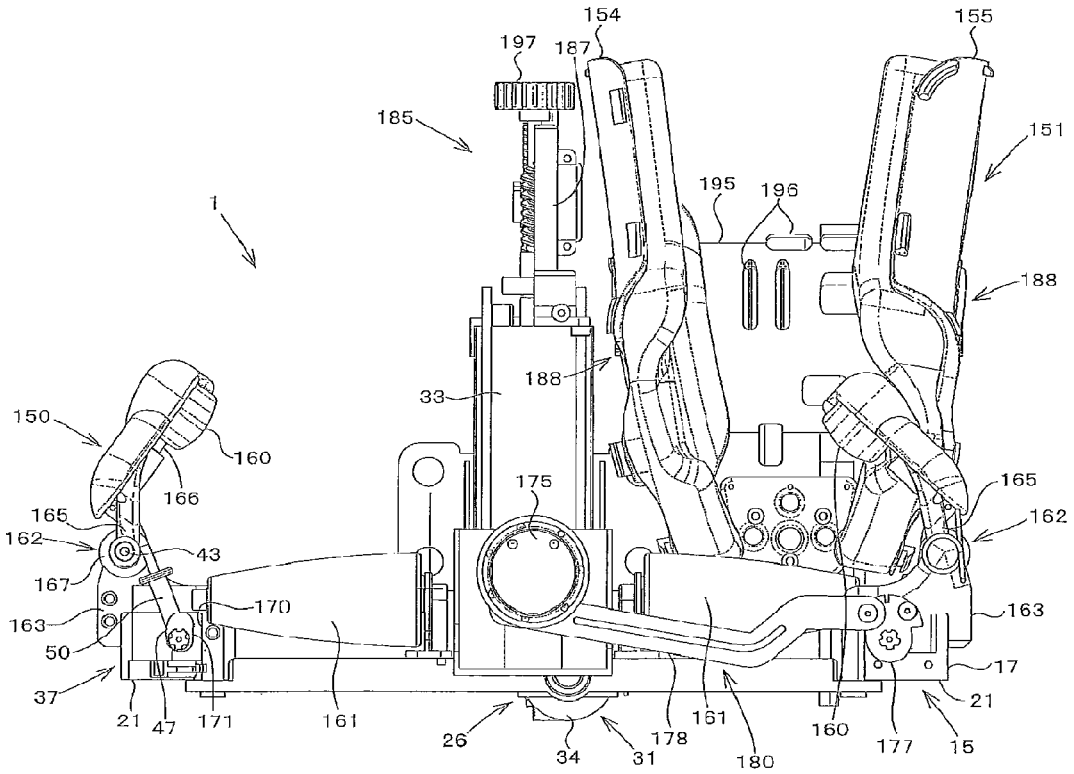
FIG. 21 is a sectional view, with parts omitted, taken along the line F-F of FIG. 15 (release position).

As shown in FIGS. 19 to 21, the front-pressing treatment member 160 is located in a position displaced somewhat obliquely outwardly (rightwardly or leftwardly) from the center of the front side of the calf L. Specifically, the left-hand treatment member 160 faces an obliquely leftward part of the front side of the calf L, whereas the right-hand treatment member 160 faces obliquely rightward part of the front side of the calf L. By virtue of such a placement, the treatment member 160 is capable of pressing a lateral part of the front side of the calf L spaced transversely outward from the shin (longitudinally extending muscle part where shallow impressions will be left under application of gentle pressure) while avoiding direct contact with the shin.

The treatment member 160 is supported at a forwardly protruding part of a stay 165 disposed so as to protrude forward along the outer side of the calf L in the transverse direction from the rail retaining portion 163 of the vertical movement slider 30 of the moving mechanism 26. The treatment member 160 has the form of a cylindrical roller (drum) expanded at its axial center. At the axis of the treatment member 160 is located a pivot shaft 166 which is coupled to the stay 165. The treatment member 160 may be either configured for free rotation about the pivot shaft 166 or mounted in an unrotatable fashion.

The pivot shaft 166 has its basal part, which is to be coupled to the stay 165, set to face outermost in the transverse direction, and extends obliquely forwardly from the basal part, with the opposite tip part pointing inward in the transverse direction (refer to an angle $\alpha$ shown in FIG. 19). The oblique protrusion of the pivot shaft 166 allows the treatment member 160 to wrap around the outer side of the calf L, yet abut against only an obliquely outward part of the front side of the calf while avoiding contact with the other area such as the outer lateral side of the calf L.

On the other hand, the back-pressing treatment member 161 supports the calf L, at the center of its back surface, in a state of being pressed rearward by the front-pressing treatment member 160. The back-pressing treatment member 161 has the form of a cylindrical roller which is installed, with its roller shaft staying horizontal in the transverse direction, relative to the front surface of the vertical movement slider 30 of the moving mechanism 26. The roller is so shaped that its thickness becomes smaller gradually from the inner end to the outer end in the transverse direction; that is, configured as a taper roller.

Thus, in the back-pressing treatment member 161, the amount of pressing force exerted on the calf L supported thereon increases gradually with increasing proximity to the inner end in the transverse direction, and contrariwise the level of surface pressure on the calf L increases gradually with increasing proximity to the outer end in the transverse direction. This helps impart adequate stimulus to the calf as a whole as is desirable. The back-pressing treatment member 161 may be either configured for free rotation about a roller shaft or mounted in an unrotatable fashion.

As the vertical movement slider 30 of the moving mechanism 26 is moved up and down, so the front-pressing treatment member 160 and the back-pressing treatment member 161 are moved up and down unitarily. In this way, the calf L receives finger-pressure massage at two locations, namely an obliquely outward part of its front side (next to the shin) and the back side, with a high degree of effectiveness.

It is noted that an elastic material such as soft or hard resin or rubber can be adopted for use as the material of construction of each of the treatment members 160 and 161.

Meanwhile, the holding mechanism 162 of the vertical massage mechanism 151 operates, upon insertion of the calf L between the front-pressing treatment member 160 and the back-pressing treatment member 161, to set the front-pressing treatment member 160 in place so that it will not move away from the back-pressing treatment member 161 beyond a predetermined limit of mutually spaced interval (opening position), as well as to let the treatment members 160 and 161 keep on pressing the front and back sides of the calf L.

The following is the specific structure of the holding mechanism 162.

That is, as shown in FIGS. 19 to 21, at the base part of the stay 165 for supporting the front-pressing treatment member 160 are disposed rocking shafts 43 extending upward and downward, respectively, the axis of which is pointing in the longitudinal direction. The upper and lower rocking shafts 43 are pivotally supported for free rotation relative to the rail retaining portion 163 of the vertical movement slider 30. Thereby, the stay 165 is free to rock horizontally about the rocking shaft 43 as a pivotal point relative to the vertical movement slider 30.

Moreover, a follower pin 50 is attached relatively to the base part of the stay 165 so as to protrude rearward beyond the rocking shaft 43. The follower pin 50 is, at its rear end, engaged with a cam rail 47 attached to the vertical rail 21 of the back frame portion 17. In this structure, even if the front-pressing treatment member 160 is subjected to a force tending to move it away from the back-pressing treatment member 161, since the follower pin 50 abuts against the cam rail 47, it follows that the front-pressing treatment member 160 is restrained from moving away from the back-pressing treatment member 161 beyond the predetermined limit of the mutually spaced interval.

Specifically, the follower pin 50 is constructed as follows. That is, the coil part of a legged coiled spring 167 whose legs protrude radially outwardly is fitted onto the rocking shaft 43, and one of the spring legs of the coiled spring 167 engages the stay 165. Moreover, the other of the spring legs of the coiled spring 167 is fitted with a sleeve, and the spring leg and the sleeve are engaged en masse with the cam rail 47. The spring leg (sleeve) engaging the cam rail 47 constitutes the follower pin 50.

In the presence of the springy effect of the coiled spring 167, the front-pressing treatment member 160 assumes opening and closing positions with some distance from the back-pressing treatment member 161.

Specifically, the cam rail 47 is constructed as follows. That is, the back frame portion 17 of the support frame 15 has formed on its front surface a straight, concavely-curved longitudinal slot 170 (refer to FIGS. 15 to 19), the lengthwise direction of which is aligned with the longitudinal direction. The longitudinal slot 170 has its lower end bent transversely inwardly to form an angular groove.

The longitudinal slot 170 receives a rail member 171. The rail member 171 is fitted only in the straight part of the longitudinal slot 170, and does not extend up to the angular groove extending from the lower end of the longitudinal slot 170.

The rail member 171 is made slimmer than the slot width of the straight part of the longitudinal slot 170. Moreover, the rail member 171 is placed alongside the inward slot wall (the rightward slot wall in the left-hand longitudinal slot 170, and the leftward slot wall in the right-hand longitudinal slot 170) of the straight part of the longitudinal slot 170 in the transverse direction. Accordingly, in the straight part of the longitudinal slot 170, in addition to the rail member 171, the follower pin 50 of the support arm 40 can be fitted so long as it is located on the side of the outward slot wall in the transverse direction.

It is noted that the stay 165 is provided with a release actuator (non-illustrated coiled spring) located between the stay and the rail retaining portion 163 of the vertical movement slider 30. The release actuator urges the stay 165, viz., the front-pressing treatment member 160, in the transversely outward direction as indicated by an arrow P in FIG. 19 (in the direction of opening up the space between the front-pressing treatment member 160 and the back-pressing treatment member 161).

The urging force of the release actuator helps keep the follower pin 50 in contact with the side surface of the rail member 171 at all times. Therefore, the follower pin 50 is allowed to move up and down within the range of the straight part of the longitudinal slot 170 while making contact with the side surface of the rail member 171. That is, as will be apparent from this explanation, the side surface of the rail member 171 on which the follower pin 50 abuts serves as the cam rail 47 for the follower pin 50.

In the third embodiment, an advance-retraction driving section 37 as described hereinbelow is employed in relation to the holding mechanism 162. That is, when the vertical movement slider 30 of the moving mechanism 26 is moved further downward beyond a predetermined lower-limit position, the advance-retraction driving section 37 operates to move the front-pressing treatment member 160 away from the back-pressing treatment member 161 beyond a predetermined limit of the mutually spaced interval (opening position).

The operation of the advance-retraction driving section 37 makes it possible to increase the spaced interval between the treatment members 160 and 161, and thereby facilitate insertion and extraction of the calf L (the treatment members 160 and 161 are out of the way of the calf L).

Specifically, the advance-retraction driving section 37 is formed of the angular groove communicating internally with the lower end of the longitudinal slot 170. That is, the angular groove is angularly contiguous to the side surface of the lower end of the rail member 171 (cam rail 47) fitted in the straight part of the longitudinal slot 170. It can thus be said that the groove inner surface of the angular groove constitutes a release rail 48 capable of guiding the follower pin 50 of the support arm 40.

Accordingly, when the vertical movement slider 30 moving along the vertical rail 21 reaches a position at the side of the lowermost part of the vertical rail 21, then the follower pin 50 of the stay 165 is guidedly introduced into the release rail 48 from the cam rail 47. At this time, the follower pin 50 is, at its rear end, inclined transversely inwardly, whereby the front-pressing treatment member 160 is driven to rock about the rocking shaft 43 in the direction of separation from the back-pressing treatment member 161 (opening position). In consequence, the treatment members 160 and 161 are spaced apart to the extent necessary to attain the release position.

After that, as the vertical movement slider 30 is moved upward along the vertical rail 21, the follower pin 50 of the stay 165 is guidedly introduced into the cam rail 47 from the release rail 48. Then, the front-pressing treatment member 160 is driven to rock about the rocking shaft 43 in the direction of approach toward the back-pressing treatment member 161. In consequence, the treatment members 160 and 161 are spaced apart to the extent necessary to attain the sandwich position. In this way, in response to the up-and-down movement of the vertical movement slider 30, the advance-retraction driving section 37 imparts advancing and retracting motion to the front-pressing treatment member 160 for the movement between the release position and the sandwich position.

As will be apparent from the foregoing explanation, the angle of protrusion of the stay 165, expressed differently, the distance from the front-pressing treatment member 160 to the back-pressing treatment member 161, is determined in accordance with the configurations of the cam rail 47 and the release rail 48.

In the third embodiment, the rail member 171 constituting the cam rail 47 is ovally (or elliptically) shaped in cross section. Moreover, the rail member 171 is, at its upper end and lower end, retained for free turn within the range of the longitudinal slot 170 formed in the back frame portion 17 of the support frame 15.

Moreover, substantially centrally of its upper end in the transverse direction the back frame portion 17 of the support frame 15 is provided with a dial operation portion 175. Further, a link 178 is disposed horizontal in a hanging fashion across a turn input piece 177 attached to the upper end (turning axis) of the rail member 171 for unitary rotation and an eccentric position relative to the dial operation portion 175. Thus, there is obtained a link mechanism 180 in which the link 178 is pushed and pulled in the horizontal direction through the turning operation of the dial operation portion 175, so that the rail member 171 can be turned via the turn input piece 177.

That is, upon horizontal turning of the dial operation portion 175 in the link mechanism 180, then the rail member 171 makes about 90° turn about its longitudinal axis, with the major axis of the ellipse defining the sectional profile of the rail member 171 pointing in the transverse direction (a state as shown in FIG. 19), as well as pointing in the front-rear direction (a state as shown in FIG. 20).

Such a turning movement of the rail member 171 takes place within the range of the longitudinal slot 170 formed in the back frame portion 17 of the support frame 15. That is, the slot width (narrowness) of the longitudinal slot 170 (concave space) depends upon the turning movement of the rail member 171. For that matter, the rail member 171 constituting the cam rail 47 turns so that its right-hand and left-hand side surfaces change orientation to point in the transverse direction. This makes it possible to shift the location of abutment between the follower pin 50 of the support arm 40 and the rail member 171 outward and inward in the transverse direction.

Hence, as shown in FIG. 19, when the rail member 171 changes its position so that the major axis of the ellipse defining the sectional profile thereof is aligned with the transverse direction through the operation of the link mechanism 180, then the follower pin 50 of the support arm 40 is brought into a state of protruding straight along the front-rear direction, whereby the front-pressing treatment member 160 comes near the back-pressing treatment member 161 to hold the calf L under strong pressure in the sandwich position.

On the other hand, as shown in FIG. 20, when the rail member 171 changes its position so that the major axis of the ellipse defining the sectional profile thereof is aligned with the front-rear direction through the operation of the link mechanism 180, then the follower pin 50 of the support arm 40 is inclined outwardly with respect to the front-rear direction, whereby the front-pressing treatment member 160 comes away from the back-pressing treatment member 161 (opening position) to lessen the pressure applied to the calf L still in the sandwich position.

The link mechanism 180 can be operated in a selective manner in accordance with the body form of a user (the thickness of the calf L) or user's preferences as to massage effect.

Next, the horizontal massage mechanism 150 mounted in the massage device 1 will be described.

The horizontal massage mechanism 150 comprises side-pressing treatment members 154 and 155 arranged vis-à-vis in the transverse direction at a spacing large enough for easy insertion of one of the feet F and a kneading mechanism 185 for operating the treatment members 154 and 155 in a manner to give a kneading treatment to the foot F.

The side-pressing treatment members 154 and 155 are arranged in a pair, and the pair is provided for each of the right and left lower legs of a user (user's body) on an individual basis.

Both of the treatment member 154 disposed face-to-face with the inner side of the foot F and the treatment member 155 disposed face-to-face with the outer side of the foot F have the shape of a plate extending in a length somewhat greater than the height of the foot F (the distance from a floor to the instep of the foot F). A material which exhibits elasticity in its thickness-wise direction, such as soft or hard resin or rubber, can be adopted for use as the material of construction of each of the treatment members 154 and 155. Moreover, it is desirable to dispose a cushion material, a cover material, or the like on the confronting inner surfaces of the treatment members 154 and 155 to provide a cushioning effect for the foot F.

The kneading mechanism 185 of the horizontal massage mechanism 150 employs, as a driving source, the motor 33 operable in forward and reverse directions incorporated in the moving mechanism 26 (the raising-lowering driving section 31) of the vertical massage mechanism 151. That is, as shown in FIGS. 15 to 18, the motor 33 is, at its front, coupled to a gear box 187 on which is rotatably supported a single rotary shaft 186 passing through the treatment members 154 and 155 in the transverse direction. The gear box 187 has built-in worm gear and worm wheel, via which the power of the motor 33 is transmitted to the rotary shaft 186.

In the location where the rotary shaft 186 passes through the treatment member 154, 155 is disposed a conversion portion 188 for converting a rotational force exerted by the rotary shaft 186 into a massage action of the treatment member 154, 155.

Figure 18:
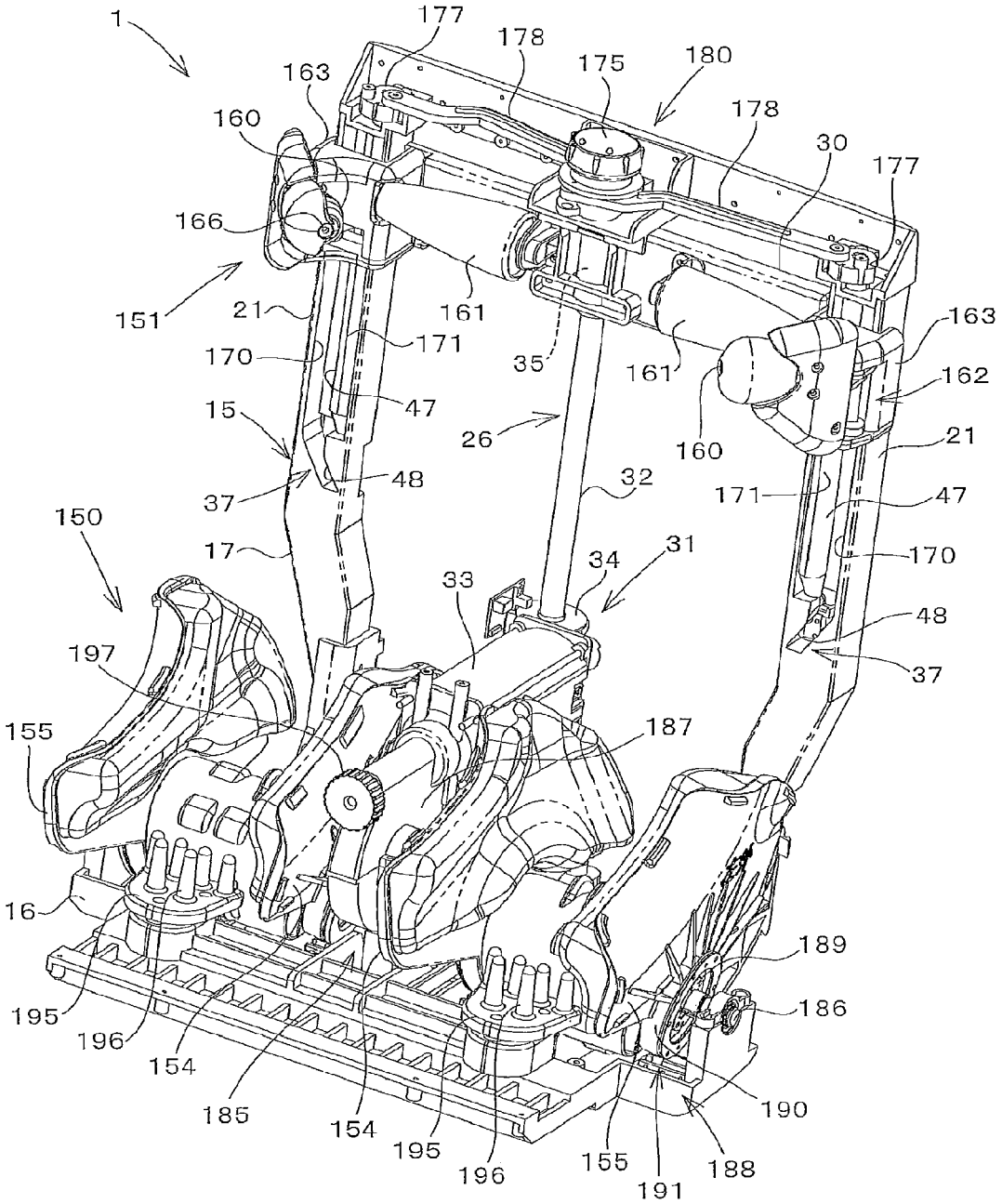
FIG. 18 is a front perspective view showing the internal structure of the massage device in accordance with the third embodiment of the present invention (uppermost sandwich position).

The conversion portion 188 comprises: a rotary boss portion 189 secured to an axial midpoint of the rotary shaft 186 for unitary rotation; a housing portion 190 disposed in the treatment member 154, 155, onto which is fitted the rotary boss portion 189 for free relative rotation; and a restraining portion 191 for restraining the housing portion 190 from rotating in response to a rotation of the rotary boss portion 189 (refer to FIG. 18).

The rotary boss portion 189 is shaped like a disk inclined with respect to the rotary shaft 186. At the outer periphery of the rotary boss portion 189 is mounted a sliding bearing attachment such as a bearing. The rotary boss portion 189 at the side of the treatment member 154 and the rotary boss portion 189 at the side of the treatment member 155 are inclined in opposite directions.

The restraining portion 191 has an engagement projection protruding downwardly from the housing portion 190. The engagement projection engages in a sliding guide slot formed in the back frame portion 16 of the support frame 15 so as to extend in the transverse direction.

Thereby, during the rotation of the rotary shaft 186, the engagement projection engaging in the sliding guide slot is allowed to slide only in the transverse direction, thus preventing co-rotation of the housing portion 190. In consequence, the treatment members 154 and 155 are rocked back and forth, as well as right and left, with the back-and-forth movement and the right-and-left movement restricted within predetermined angle ranges. As has already been described, since the rotary boss portions 189 disposed at the side of the right-hand and left-hand treatment members 154 and 155, respectively, are inclined in opposite directions with respect to the rotary shaft 186, it follows that, in the treatment members 154 and 155, when their front parts are close to each other, their rear parts are away from each other. In other words, the treatment members 154 and 155 stay in a shape like the letter inverted V when viewed from a top.

Then, as the rotary shaft 186 is rotated, the treatment members 154 and 155 are so operated that their front parts move away from each other, and their rear parts move close to each other correspondingly, whereafter their front parts move close to each other, and their rear parts move away from each other. From then on, the treatment members 154 and 155 repeats the above cycle of operation.

In the region between the treatment members 154 and 155 is placed a foot support member 195 for supporting the arch of the foot F, and the back of toe and the back of heel of the foot F. The foot support member 195 has a plurality of projections 196 formed on the upper surface thereof. The way of arrangement, the seated height, the material, and the number of the projections 196 can be determined selectively in accordance with the positions of pressure points on the sole of the foot F.

Next, a description will be given as to the operation of the massage device 1 of the third embodiment based on the conditions for use.

Figure 15:
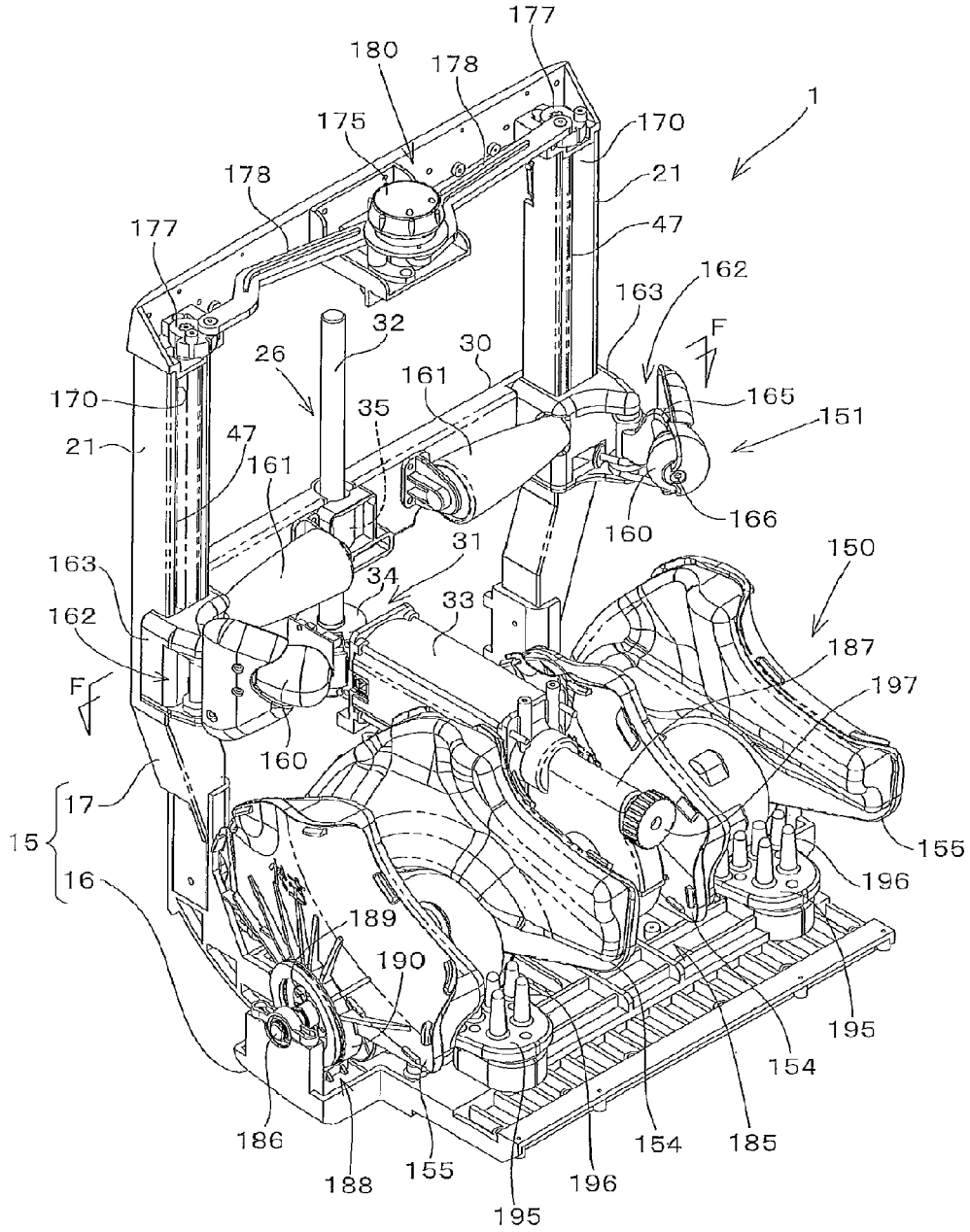
FIG. 15 is a front perspective view showing the internal structure of the massage device in accordance with a third embodiment of the present invention (release position).
Figure 16:
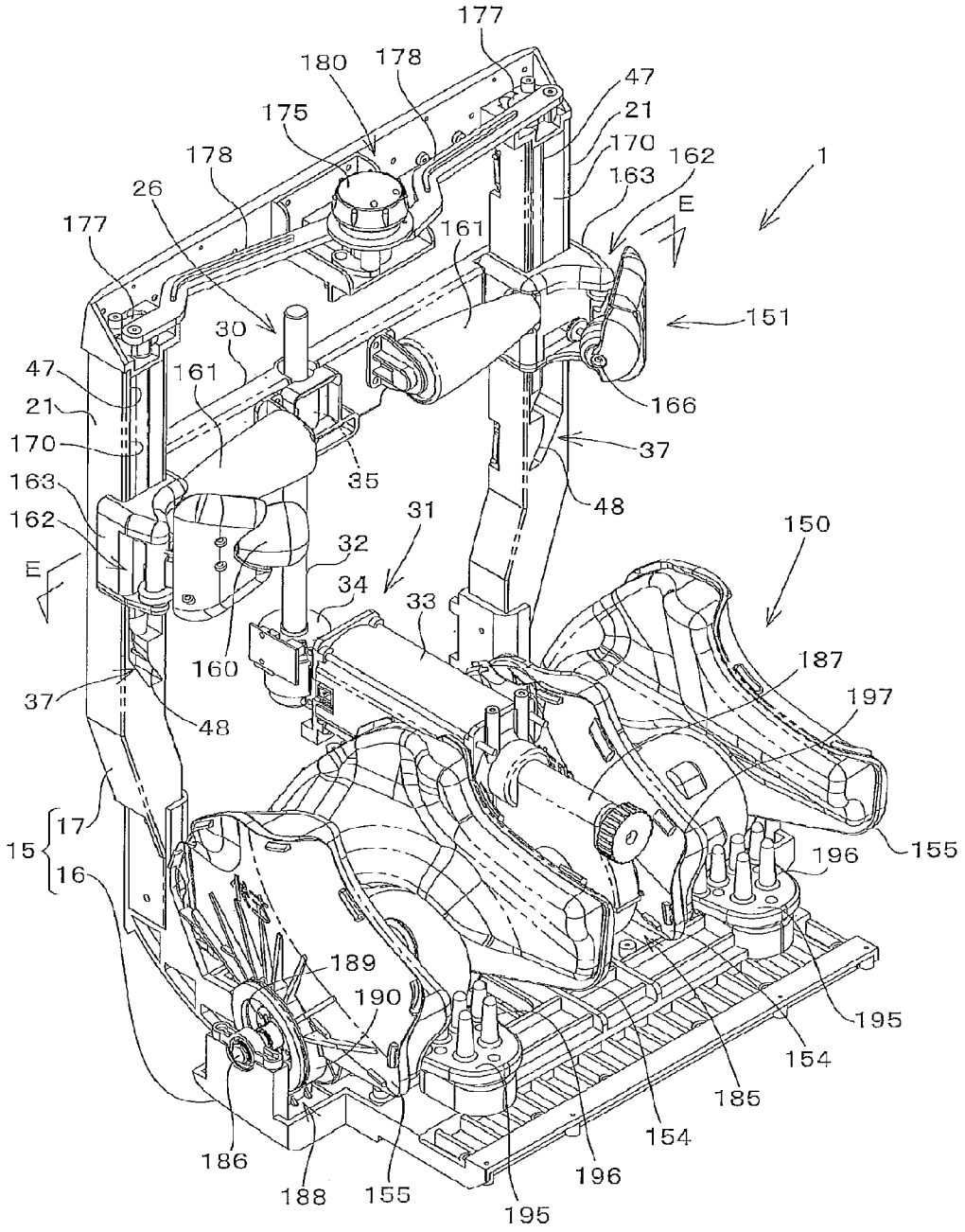
FIG. 16 is a front perspective view showing the internal structure of the massage device in accordance with the third embodiment of the present invention (sandwich position).
Figure 17:
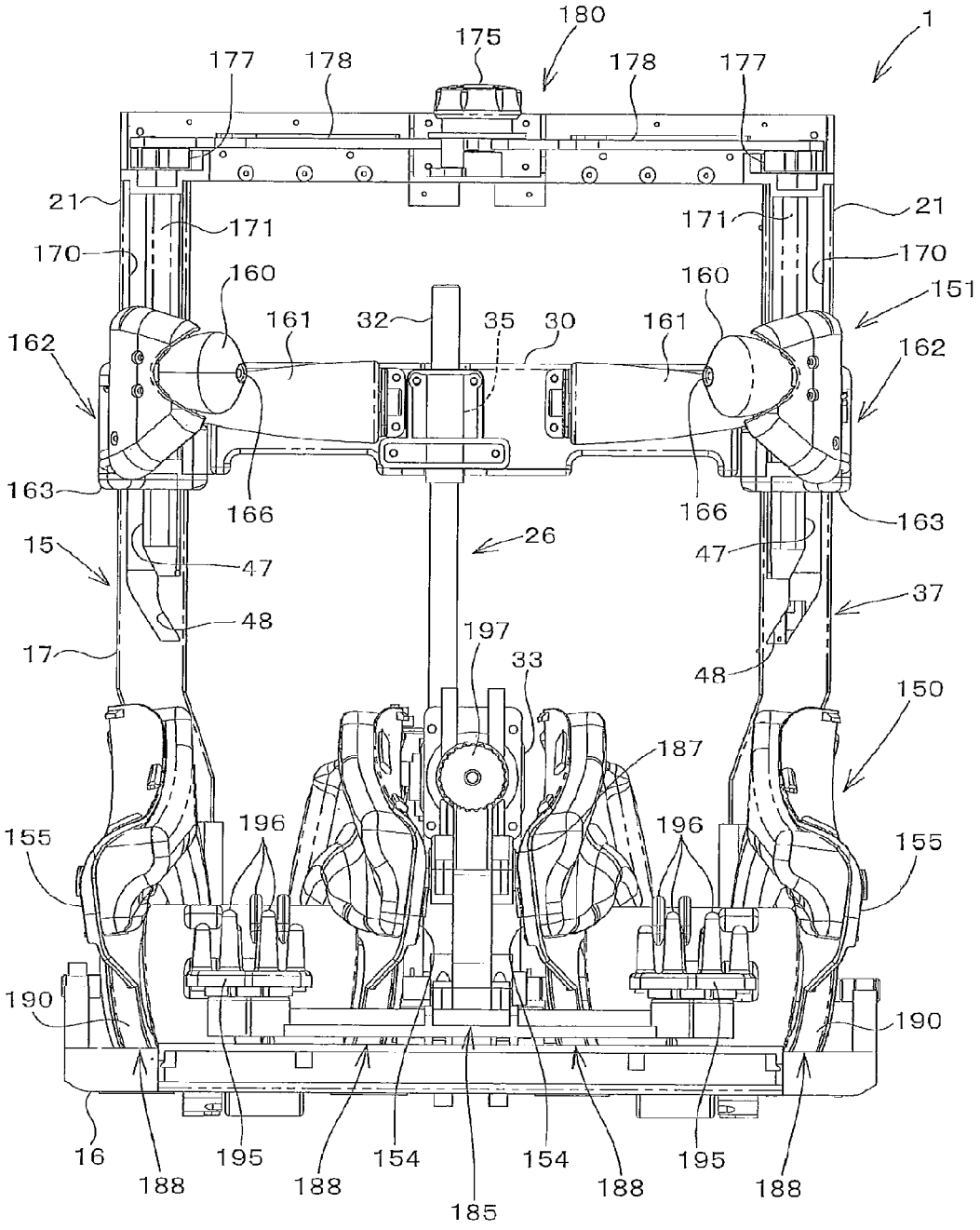
FIG. 17 is a front view showing the internal structure of the massage device in accordance with the third embodiment of the present invention (sandwich position).

When the power switch or operation switch is in the OFF position, as shown in FIG. 15, the massage device 1 stays with the front-pressing treatment member 160 and the back-pressing treatment member 161 of the vertical massage mechanism 151 kept at rest in their lowermost positions.

The front-pressing treatment member 160 and the back-pressing treatment member 161 remaining at rest in the lowermost positions are in a state of being spaced fully apart, wherefore the calf L can be put in and out of the region between the treatment members with ease.

To begin with, a user inserts each of his/her right and left calves L in the region between the front-pressing treatment member 160 and the back-pressing treatment member 161, and also inserts each of his/her right and left feet F in the region between the side-pressing treatment members 154 and 155 of the horizontal massage mechanism 150.

Under this condition, the power switch or operation switch is turned to the ON position, whereupon the motor 33 is set in motion. In the vertical massage mechanism 151, the moving mechanism 26 starts to move the vertical movement slider 30 upward via the reduction gear portion 34 of the raising-lowering driving section 31. Moreover, in the horizontal massage mechanism 150, the rotary shaft 186 starts to rotate via the gear box 187 of the kneading mechanism 185.

In the vertical massage mechanism 151, upon upward movement of the vertical movement slider 30, the follower pin 50 of the support arm 40 is moved from the release rail 48 to the cam rail 47 with consequent abutment between the follower pin 50 and the cam rail 47. As a result, the distance between the front-pressing treatment member 160 and the back-pressing treatment member 161 decreases.

That is, under this condition, the front-pressing treatment member 160 presses an obliquely outward part of the front side of the calf L (next to the shin), and the back-pressing treatment member 161 presses the back side of the calf L. In this way, the calf L is subjected to finger-pressure massage with a high degree of effectiveness.

Still under the above condition, the vertical movement slider 30 repeats a cycle of reciprocal upward and downward movements at least one time, or several times as required, in so far as the follower pin 50 of the support arm 40 is kept contact with the cam rail 47 (except for the release rail 48). In the case of repeating the cycle over several times, it is advisable to adopt a system based on timer circuitry or counting circuitry, or a system based on manual switching operation.

On the other hand, in the horizontal massage mechanism 150, as the rotary shaft 186 is rotated, the side-pressing treatment members 154 and 155 are so operated that their front parts move away from each other and their rear parts move close to each other, whereafter their front parts move close to each other and their rear parts move away from each other, thereby producing repeated kneading massage actions. The foot F receives the kneading massage at both sides in the transverse direction.

It will thus become possible to provide innovative and comfortable massage effect, as well as to show promise for practical and direct improvement of the flow of blood and lymph.

It is noted that the vertical massage mechanism 151 and the horizontal massage mechanism 150 may be designed to operate in synchronization with each other at all times, or may be designed to operate independently of each other. It is advisable that the operation modes of the massage mechanisms can be set in a selective manner in accordance with the desire of a user.

Just like the first embodiment, the third embodiment may be provided with a vibration mechanism.

For example, by shaping the cam rail 47 so that its thickness varies from part to part in the longitudinal direction, the distance from the front-pressing treatment member 160 to the back-pressing treatment member 161 can be changed to conform to the shape of the calf L (adapt to variation in calf thickness).

As an insurance against a power failure or the like trouble, it is possible to add a mechanism by which a user is able to release forcibly the restraint put on the calf L by the horizontal massage mechanism 150, as well as the restraint put on the foot F by the vertical massage mechanism 151 (a release mechanism).

For example, in the third embodiment, as the release mechanism, there is provided a release dial 197 which is so disposed as to protrude from the front surface of the gear box 187 coupled to the front side of the motor 33.

By turning the release dial 197, the motor shaft of the motor 33 can be rotated via the interior of the gear box 187. In this way, it is possible to release the restraint put on the calf L by the horizontal massage mechanism 150, as well as the restraint put on the foot F by the vertical massage mechanism 151. Such a mechanism serves a useful function also in maintenance of individual mechanisms.

It should be understood that the embodiments as set forth hereinabove are considered in all respects as illustrative only and not restrictive. The scope of the present invention is indicated by the appended claims rather than the foregoing description, and all changes that come within the meaning of and the range of equivalency of the claims are intended to be embraced therein.

For example, the treatment member and the pressing member may each be formed of a roller or ball (spherical body) which is free to rotate or rotatably driven in its moving direction.

Moreover, although the holding mechanism is designed to move both of the paired treatment members in a direction widthwisely of a body part inserted between them to hold the body part in sandwich style, it is no problem to design the holding mechanism to move only one of the paired treatment members for holding the body part.

Further, the massage device of the present invention may be applied to an arm (upper limb) massage device.

Still further, the massage device of the present invention may be mounted at the front of a seat of a chair-type massage apparatus so as to serve also as a footrest.

EXPLANATION OF REFERENCE NUMERALS AND SYMBOLS

1 massage device
2 casing
4 first treatment recess
5 second treatment recess
6 lining
10 vertical side-pressing massage mechanism
11 vertical back-pressing massage mechanism
12 horizontal side-pressing massage mechanism
13 horizontal back-pressing massage mechanism
15 support frame
16 base frame portion
16*a* leg bar
16*b* horizontal bar
17 back frame portion
17*a* vertical bar
20 horizontal rail
21 vertical rail
22 moving mechanism
23 treatment member
24 treatment member
25 finger-pressure mechanism
26 moving mechanism
27 pressure-point pressing member
30 vertical movement slider
31 raising-lowering driving section
32 screw shaft
33 motor
34 reduction gear portion
35 nut member
37 advance-retraction driving section
40 support arm
41 support arm
43 rocking shaft
44 rocking shaft
45 release actuator
46 release actuator
47 cam rail
47*a* cam face
47*b* ramp guide face
47*c* vertex
47*d* camming-free region
50 follower pin
51 follower pin
53 treatment member
54 treatment member
55 finger-pressure mechanism
56 moving mechanism
57 pressure-point pressing member
60 horizontal movement slider
61 advance-retraction driving section
62 screw shaft
64 reduction gear portion
65 nut member
67 advance-retraction driving section
70 support arm
71 support arm
73 rocking shaft
74 rocking shaft
75 release actuator
76 release actuator
77 cam rail
77*a* cam face
77*b* ramp guide face
77*c* vertex
77*d* camming-free region
80 follower pin
81 follower pin
85 hole
86 follower
88 cam face
90 vibration mechanism
91 vibration-generating motor
100 shock-absorbing leg
101 horizontal vibration plate
102 shock-absorbing leg
103 vertical vibration plate
105 small opening
106 finger-pressure projection
107 large opening
109 finger-pressure projection
110 large opening
112 vibration receiving pad
113 eccentric weight
120 motor support
121 vibration-isolating leg
122 motor bracket
150 horizontal massage mechanism
151 vertical massage mechanism
154, 155 side-pressing treatment members
160 front-pressing treatment member
161 back-pressing treatment member
162 holding mechanism
163 rail retaining portion
165 stay
166 pivot shaft
167 coiled spring
170 longitudinal slot
171 rail member
175 dial operation portion
177 turn input piece
178 link
180 link mechanism
185 kneading mechanism

186 rotary shaft
187 gear box
188 conversion portion
189 rotary boss portion
190 housing portion
191 restraining portion
195 foot support member
196 projection
197 release dial
F foot
L calf
S operating range
T operating range

The invention claimed is:

1. A lower-leg massage device comprising:
a vertical massage mechanism; and
a horizontal massage mechanism;
the vertical massage mechanism comprising:
a front-pressing treatment member adapted to press on an obliquely outward part of a front side of a calf, and a back-pressing treatment member disposed rearwardly of the calf so as to be face-to-face with the front-pressing treatment member, so that the obliquely outward part of the front side of the calf is able to be pressed by the front-pressing treatment member while the back-pressing treatment member simultaneously supports a back side of the calf, the calf lying between a knee and an ankle;
a holding mechanism adapted to operate the front-pressing treatment member and the back-pressing treatment member; and
a moving mechanism adapted to impart an up-and-down motion to the front-pressing treatment member, the back-pressing treatment member, and the holding mechanism in a direction of a length of the calf while a holding condition of the front-pressing treatment member and the back-pressing treatment member effected by the holding mechanism is maintained; and
wherein the vertical massage mechanism and the horizontal massage mechanism are adapted to work simultaneously.

2. The lower-leg massage device according to claim 1,
wherein the holding mechanism is adapted to rotate the front-pressing treatment member in a lateral direction toward the back-pressing treatment member when preparing for a holding position, as well as to retract the front-pressing treatment member away from the back-pressing treatment member when preparing for a release position, and
wherein, when in the holding position, the front-pressing treatment member and the back-pressing treatment member are close to each other in order to hold and press the calf between the front-pressing treatment member and the back-pressing treatment member, and
contrariwise, when in the release position, the front-pressing treatment member and the back-pressing treatment member are spaced fully apart.

3. The lower-leg massage device according to claim 2,
wherein one end or another end of a range of up-and-down movement of the front-pressing treatment member and the back-pressing treatment member effected by the moving mechanism corresponds to the release position of the front-pressing treatment member with respect to the back-pressing treatment member.

4. The lower-leg massage device according to claim 2, wherein each of the front-pressing treatment member and the back-pressing treatment member is fist-sized.

5. The lower-leg massage device according to claim 2,
wherein the holding mechanism is adapted to operate the front-pressing treatment member and the back-pressing treatment member in a manner to hold the calf between the front-pressing treatment member and the back-pressing treatment member while pressure is applied to the obliquely outward part of a front side of the calf in a transverse direction and the heel of the calf.

6. The lower-leg massage device according to claim 1, wherein the vertical massage mechanism and the horizontal massage mechanism are adapted to be operated simultaneously by a single motor with a drive shaft,
the drive shaft of the motor extends horizontally, and a first end of the drive shaft being forward of the calf and a second end of the drive shaft being rearward of the calf.

7. The lower-leg massage device according to claim 1,
the horizontal massage mechanism comprising:
a pair of side-pressing treatment members arranged face-to-face with each other at a spacing large enough for insertion of a foot between the pair of side-pressing treatment members, the foot lying below the ankle;
a kneading mechanism adapted to operate the side-pressing treatment members in a manner to enable a kneading treatment to be provided to the foot; and
a foot support member disposed in a region between the side-pressing treatment members and being adapted to support a heel of the foot, the foot support member having a projection adapted to massage the heel of the foot.

8. The lower-leg massage device according to claim 7,
wherein the vertical massage mechanism and the horizontal massage mechanism are adapted to be operated simultaneously by a single motor with a drive shaft,
the drive shaft including:
a first end connected at one end to a gear box for driving the horizontal massage mechanism, and
a second end connected via a reduction gear portion to a vertically-extending feed screw shaft for driving the vertical massage mechanism simultaneously with the horizontal massage mechanism,
wherein the drive shaft of the motor extends horizontally, and first end being forward of the calf and the second end being rearward of the calf.

9. A lower-leg massage device comprising:
a vertical massage mechanism; and
a horizontal massage mechanism;
the vertical massage mechanism comprising:
a front-pressing treatment member adapted to press on an obliquely outward part of a front side of a first therapeutic part, and a back-pressing treatment member disposed rearwardly of the first therapeutic part so as to be face-to-face with the front-pressing treatment member, so that the obliquely outward part of the front side of the first therapeutic part is able to be pressed by the front-pressing treatment member while the back-pressing treatment member simultaneously supports a back side of the first therapeutic part, the first therapeutic part lying between a knee and an ankle;
a holding mechanism adapted to operate the front-pressing treatment member and the back-pressing treatment member; and
a moving mechanism adapted to impart an up-and-down motion to the front-pressing treatment member, the back-pressing treatment member, and the holding mechanism in a direction of a length of the first therapeutic part while a holding condition of the front-pressing treatment member and the back-pressing treatment member effected by the holding mechanism is maintained; and thereby enabling the vertical massage mechanism and the horizontal massage mechanism to work simultaneously.

10. The lower-leg massage device according to claim 9, wherein the holding mechanism is adapted to rotate the front-pressing treatment member the back-pressing treatment member toward the back-pressing treatment member when preparing for a holding position, as well as to retract the front-pressing treatment member away from the back-pressing treatment member and toward a release position when preparing for the release position, and wherein, when in the holding position, the front-pressing treatment member and the back-pressing treatment member are close to each other in order to hold and press the first therapeutic part between the front-pressing treatment member and the back-pressing treatment member, and contrariwise when in the release position, the front-pressing treatment member and the back-pressing treatment member are spaced fully apart.

11. The lower-leg massage device according to claim 10, wherein one end or another end of a range of up-and-down movement of the front-pressing treatment member and the back-pressing treatment member effected by the moving mechanism corresponds to the release position of the front-pressing treatment member with respect to the back-pressing treatment member.

12. The lower-leg massage device according to claim 10, wherein each of the front-pressing treatment member and the back-pressing treatment member is fist-sized.

13. The lower-leg massage device according to claim 10, wherein the holding mechanism is adapted to operate the front-pressing treatment member and the back-pressing treatment member in a manner to hold the first therapeutic part between the front-pressing treatment member and the back-pressing treatment member while pressure is applied to the obliquely outward part of a front side of the first therapeutic part in a transverse direction and the heel of the first therapeutic part.

14. The lower-leg massage device according to claim 13, wherein the vertical massage mechanism and the horizontal massage mechanism are adapted to be operated simultaneously by a single motor with a drive shaft, the drive shaft of the motor extends horizontally, and a first end of the drive shaft being forward of the calf and a second end of the drive shaft being rearward of the calf.

15. The lower-leg massage device according to claim 9, the horizontal massage mechanism comprising:

a pair of side-pressing treatment members arranged face-to-face with each other at a spacing large enough for insertion of a second therapeutic part between the pair of side-pressing treatment members, the second therapeutic part lying below the ankle and below the first therapeutic part;

a kneading mechanism adapted to operate the side-pressing treatment members in a manner to enable a kneading treatment to be provided to the second therapeutic part; and a support member disposed in a region between the side-pressing treatment members and being adapted to support a heel of the second therapeutic part, the support member having a projection adapted to massage the heel of the second therapeutic part.

16. The lower-leg massage device according to claim 9, wherein the vertical massage mechanism and the horizontal massage mechanism is adapted to be operated simultaneously by a single motor with a drive shaft, the drive shaft including:

a first end connected at one end to a gear box for driving the horizontal massage mechanism, and a second end connected via a reduction gear portion to a vertically-extending feed screw shaft for driving the vertical massage mechanism simultaneously with the horizontal massage mechanism, wherein the drive shaft of the motor extends horizontally, and first end being forward of the calf and the second end being rearward of the calf.

* * * * *